US007758034B1

(12) United States Patent
Namba et al.

(10) Patent No.: US 7,758,034 B1
(45) Date of Patent: Jul. 20, 2010

(54) SHEETS POST PROCESSING DEVICE INCLUDING STAPLER FOR VARIABLE WIDTHS

(75) Inventors: Toyoaki Namba, Higashiosaka (JP); Kyosuke Taka, Nara (JP); Hideki Mimura, Yamanashi (JP); Hiroshi Saegusa, Yamanashi (JP); Tsuyoshi Asahara, Yamanashi (JP)

(73) Assignees: Nisca Kabushiki Kaisha, Minamikoma-Gun (JP); Sharp Kabushiki Kaisha, Osaka-Shi (JP)

( * ) Notice: Subject to any disclaimer, the term of this patent is extended or adjusted under 35 U.S.C. 154(b) by 0 days.

(21) Appl. No.: 09/127,067

(22) Filed: Jul. 31, 1998

(30) Foreign Application Priority Data

Jul. 31, 1997 (JP) ..... 9-205539

(51) Int. Cl.
*B65H 33/04* (2006.01)
*B65H 39/00* (2006.01)

(52) U.S. Cl. ..... 270/58.07

(58) Field of Classification Search ..... 270/58.07, 270/58.08, 58.09, 58.11, 58.12, 58.13; 271/218; 414/790.02, 790.03, 790.04, 789.9
See application file for complete search history.

(56) References Cited

U.S. PATENT DOCUMENTS 5,150,168 A * 9/1992 Kamath et al. ..... 271/218
5,384,634 A * 1/1995 Takehara et al. ..... 355/323
5,673,906 A * 10/1997 Furuya et al. ..... 270/58.14
5,799,935 A * 9/1998 Yamanushi et al. ..... 270/58.08
5,806,750 A * 9/1998 Yamanushi et al. ..... 227/155
5,957,652 A * 9/1999 Mimura et al. ..... 414/790.04
5,997,239 A * 12/1999 Mimura et al. ..... 414/789.9

FOREIGN PATENT DOCUMENTS

| | | |
|---|---|---|
| JP | 62-288090 | 12/1987 |
| JP | 4-290800 | 10/1992 |
| JP | 6-9142 | 1/1994 |

* cited by examiner

*Primary Examiner*—Patrick Mackey
*Assistant Examiner*—Mark Hageman
(74) *Attorney, Agent, or Firm*—Day Pitney LLP

(57) ABSTRACT

There is disclosed a sheet post-processing device which can staple a corner of a sheet bunch conveyed from an image forming device and makes a transverse width of a housing smaller or compact. By disposing a stapler in one end on a sheet processing tray inside a sheet conveying port, the transverse width of the housing is made smaller. For this purpose, the sheet post-processing stores sheets conveyed from the image forming device, matches the sheet bunch stored staples the matched sheet bunch and transfers the matched sheet bunch toward the other end of the sheet bunch and subsequently transfers the stapled sheet bunch toward one end of the sheet bunch.

10 Claims, 22 Drawing Sheets

SHEETS POST PROCESSING DEVICE INCLUDING STAPLER FOR VARIABLE WIDTHS

BACKGROUND OF THE INVENTION (i) Field of the Invention

The present invention relates to a sheet post-processing device which matches a plurality of piled sheets with images formed thereon conveyed from a copying machine, a facsimile machine, a printer or another image forming device to staple the plurality of sheets.

(ii) Description of the Related Art

Sheets with images formed thereon by the image forming device are continuously piled onto a sheet processing tray (hereinafter referred to as the processing tray) of a sheet processing device (hereinafter referred to as the post-processing device). A bunch of a predetermined number of sheets piled on the processing tray are matched, then stapled, and sent toward a sheet accumulating tray (hereinafter referred to as the accumulating tray) which is adjacent to the post-processing device.

In the post-processing device, in order to staple at least one predetermined portion of the sheet bunch on the processing tray, stapling can be performed while moving a stapling device (hereinafter referred to as the stapler) transversely across the processing tray over a side face of the sheet bunch. However, when the stapler is moved in a position above a surface of the processing tray and along a sheet conveying port from the image forming device, a cost of mechanical components for the purpose is raised, and it is difficult to secure an arrangement space of the mechanical components.

To solve the problem, in a conventional art, a processing device is used in which when a sheet bunch is stapled, predetermined portions of the sheet bunch are stapled by moving the sheet bunch instead of moving the stapler. The sheet bunch stapled on the processing tray is transferred toward the accumulating tray adjacent to the processing device in a direction orthogonal to a direction in which sheets are conveyed from the image forming device. Therefore, if the sheet bunch is stapled while being transferred, the stapler does not need to be moved.

For this reason, in the conventional processing device, the stapler is fixedly disposed in one end of the processing tray to which the sheet bunch is sent, while a sheet holding means (referred to as the holding means) serving as a sheet transfer means for transferring the sheet bunch is disposed in the other end of the processing tray, so that when the sheet bunch is transferred to the stapler by the holding means, the predetermined portion of the sheet bunch is stapled by the stapler.

In this case, the stapler requires to staple a portion closely adjacent to the end of the sheet bunch in a sheet-bunch transfer direction. Therefore, as aforementioned, the stapler needs to be disposed in one end of the processing tray in the sheet-bunch conveying direction and close to the sheet-bunch end in the sheet-bunch transfer direction. Furthermore, the holding means needs to be disposed in the other end of the processing tray and outside the sheet conveying port from the image forming device.

For this end, a transverse width of a processing-device housing is determined by considering at least a width (determined by a maximum width of the sheet to be processed) of the sheet discharge port disposed on the processing tray, a size of the stapler disposed in one end on the processing tray and a size of the holding means disposed in the other end on the processing tray. As a result, the transverse width of the processing device should be large-sized.

SUMMARY OF THE INVENTION

Wherefore, an object of the invention is to provide a sheet post-processing device in which a stapler disposed in one end on a processing tray is disposed inside a sheet conveying port to reduce a transverse width of a sheet post-processing device housing.

To attain this and other objects, the invention provides a sheet post-processing device which comprises storage means for storing sheets conveyed from an image forming device, matching means for regulating at least one end of a sheet bunch stored in the storage means to match the sheets stored in the storage means, stapling means for stapling the sheet bunch matched by the matching means and transfer means for once transferring the sheet bunch matched by the matching means toward the other end of the sheet bunch and transferring the sheet bunch stapled by the stapling means toward the one end.

Here, when the transfer means once transfers the sheet bunch matched by the matching means toward the other end of the sheet bunch, a binding position of the sheet bunch which is between the matching means and a stapling position of the stapling means in a position where the sheet bunch is matched by the matching means is moved toward the stapling position.

Additionally, after the transfer means transfers the sheet bunch toward the other end and the stapling means staples the binding position of the sheet bunch between the matching means and the stapling position of the stapling means, the stapling means can staple one portion or plural portions of the sheet bunch while the sheet bunch is transferred toward the one end.

DETAILED DESCRIPTION OF THE PREFERRED EMBODIMENTS

An embodiment of a sheet discharge opening shielding device in a sheet accumulation processing device (hereinafter referred to the accumulation processing device) according to the invention will be described with reference to the drawings. Specifically, a sheet post-processing device (hereinafter referred to as the post-processing device) for stapling or processing otherwise a plurality of sheets discharged from an image forming device to a sheet processing tray and the entire accumulation processing device for receiving a processed sheet bunch to discharge and accumulate the sheet bunch onto a predetermined sheet discharge tray (hereinafter referred to as the accumulating tray) will be described.

Figure 1:
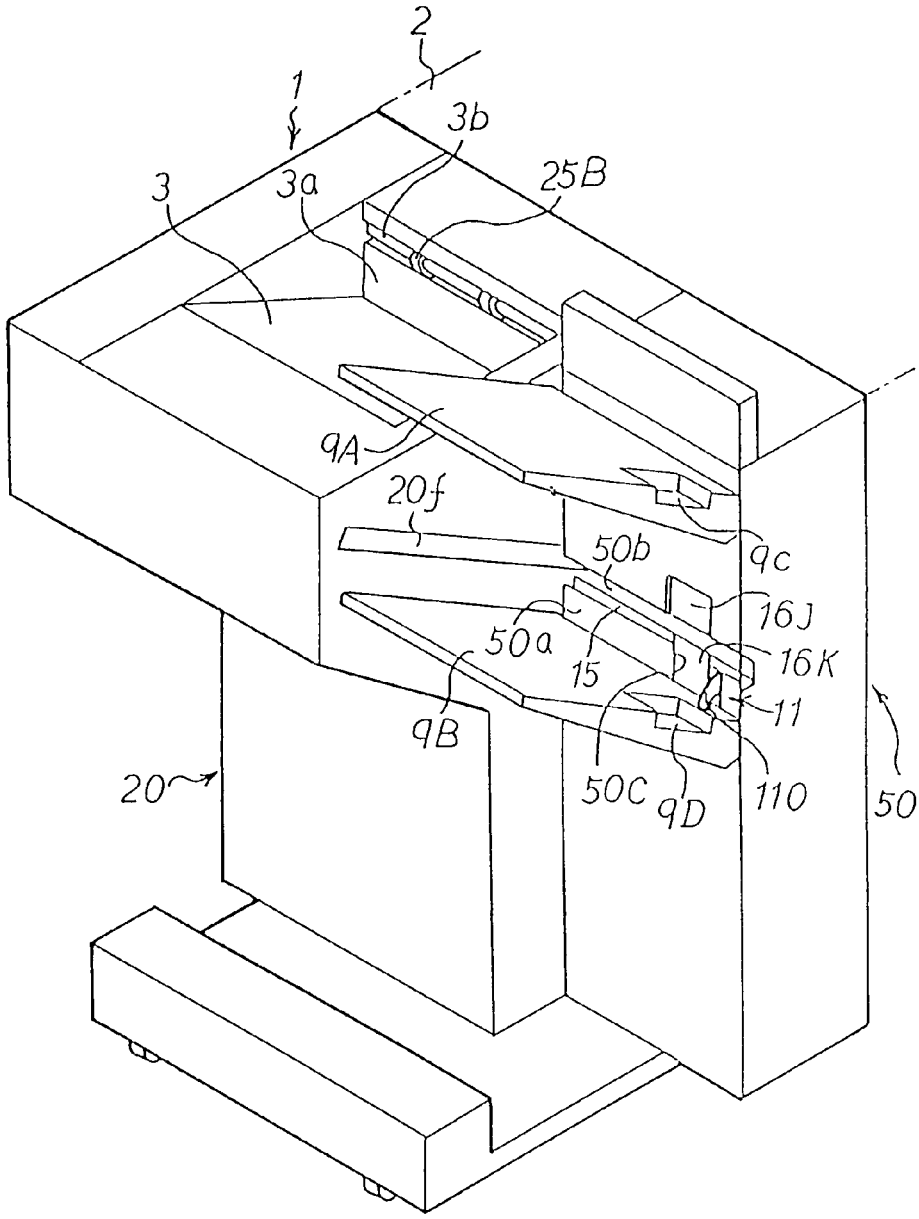
FIG. 1 is a perspective view showing a front appearance of a sheet processing device according to the invention.
Figure 2:
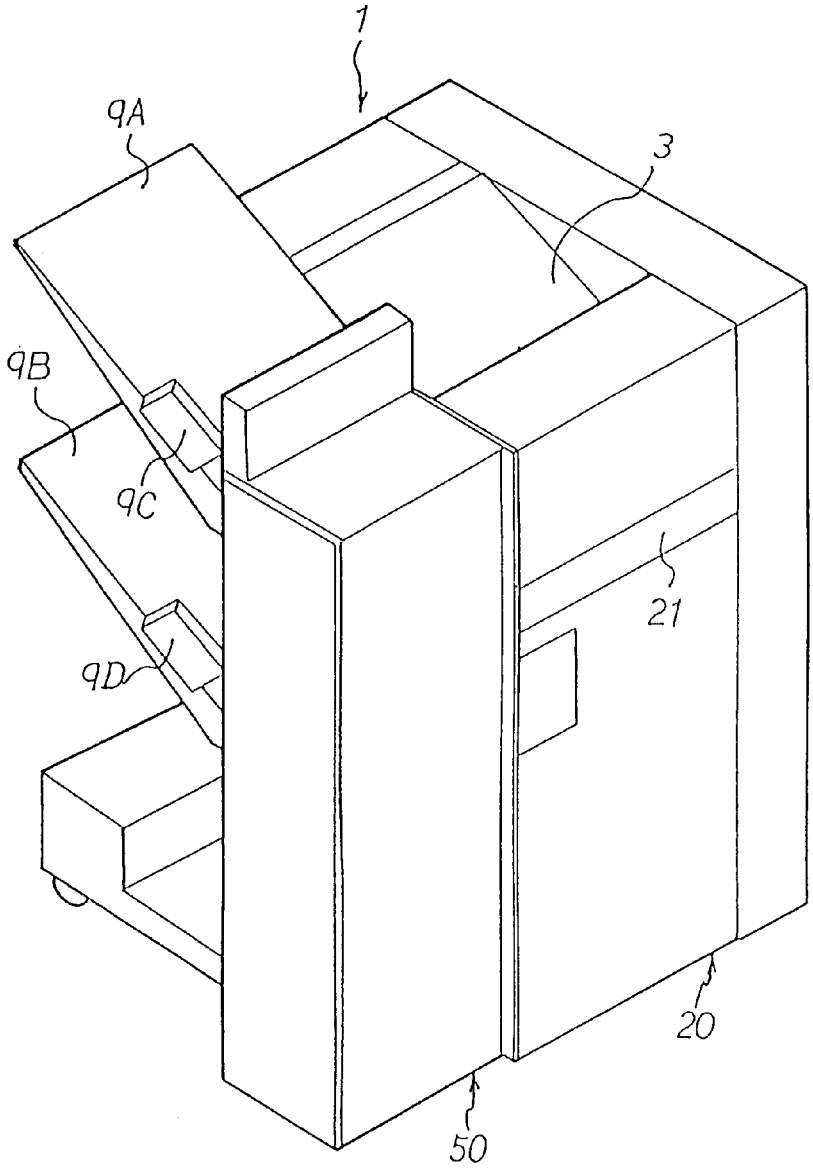
FIG. 2 is a perspective view showing a rear appearance of the sheet processing device.
Figure 3:
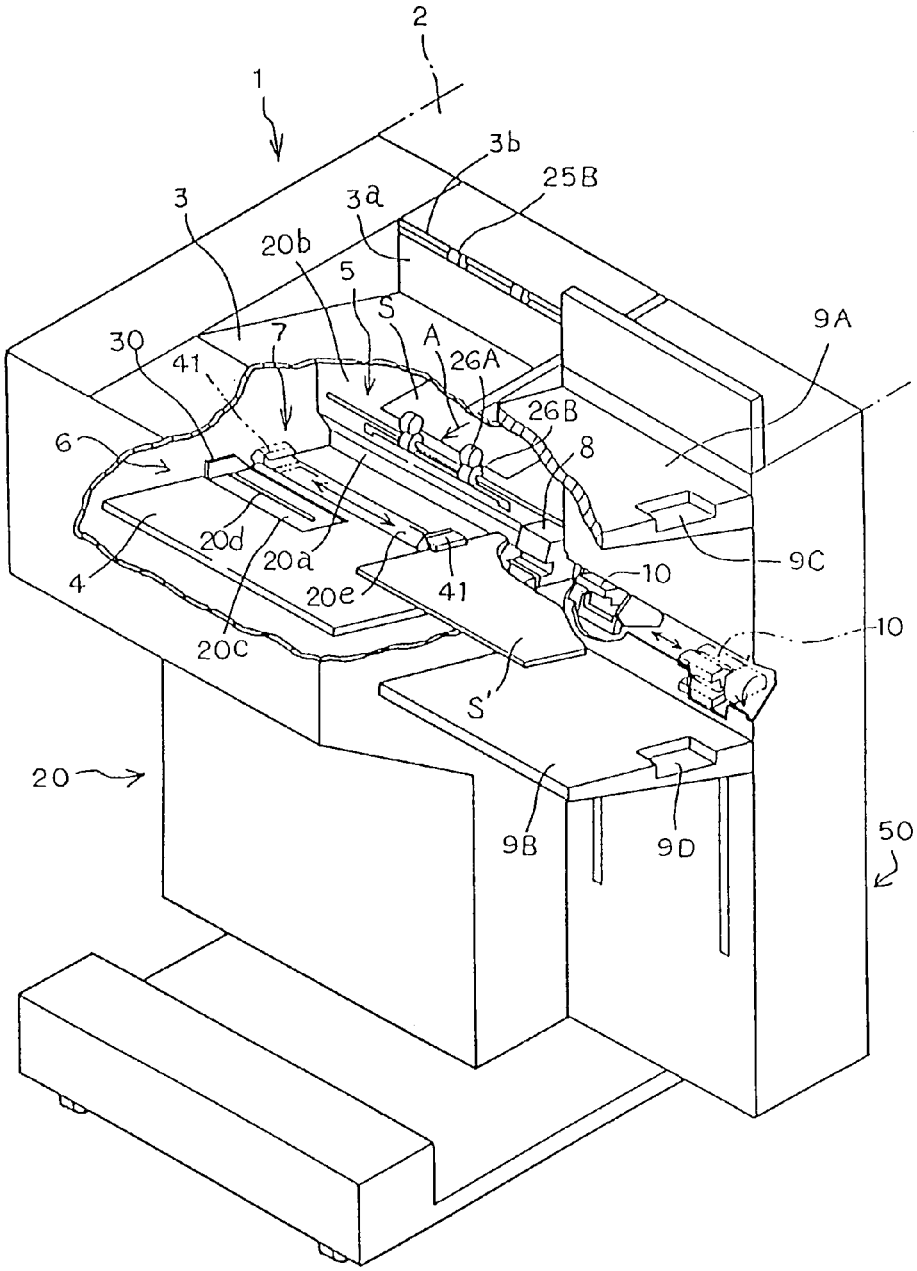
FIG. 3 is a partially broken perspective view showing the appearance of the sheet processing device.

In FIGS. 1 to 3, a sheet processing device 1 is provided with a post-processing device unit 20 and an accumulation processing device unit 50, each unit being constituted of an independent housing.

Figure 4:
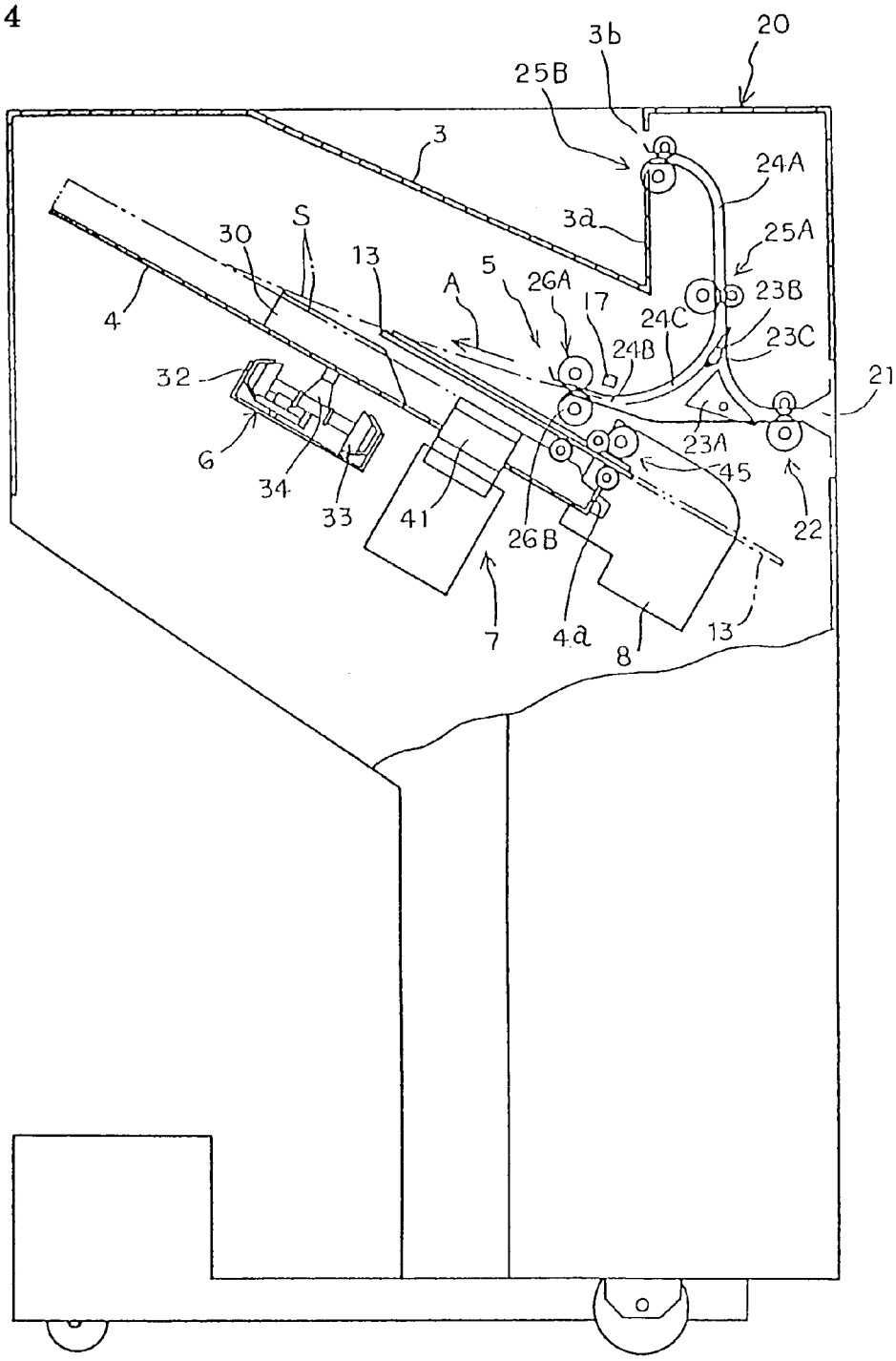
FIG. 4 is a partially broken side view of a post-processing device unit.

The post-processing device unit 20 is provided with, as shown in FIG. 3, a preparatory conveying means 5 for sorting sheets S with images formed thereon successively discharged from a copying machine 2 to an accumulating tray 3 if a post-processing is unnecessary and to a processing tray 4 if the post-processing is necessary; a matching means 6 for matching the plural sheets S received on the processing tray 4; a first holding means 7 for holding and conveying a matched sheet bunch S'; a stapler 8 for stapling the sheet bunch S' held by the first holding means 7; and, as shown in FIG. 4, an auxiliary tray 13 positioned above the processing tray 4 and below the preparatory conveying means 5.

Furthermore, as shown in FIG. 3, the post-processing device unit 20 is provided with a vertical wall 20*a* functioning as a storing reference surface of the sheets S relative to the processing tray 4; an opening 20*b* via which the sheets S are discharged; rail grooves 20*c* and 20*d* for allowing matching members 30 and holding members 34 described later to move; a rail groove 20*e* for allowing the first holding means 7 to move; and an opening 20*f* (FIG. 1) for allowing the sheet bunch S' held by the first holding means 7 and stapled to move from the processing tray 4 to two accumulating trays 9A and 9B.

Additionally, as shown in FIG. 1, the opening 20*f* is in parallel with the processing tray 4 and with the accumulating trays 9A and 9B. Therefore, the sheet bunch S' moves in parallel from the processing tray 4 to the accumulating trays 9A and 9B. Thereby, the alignment of the sheet bunch S' accumulated to the accumulating tray 9A or 9B is effectively maintained.

Figure 5:
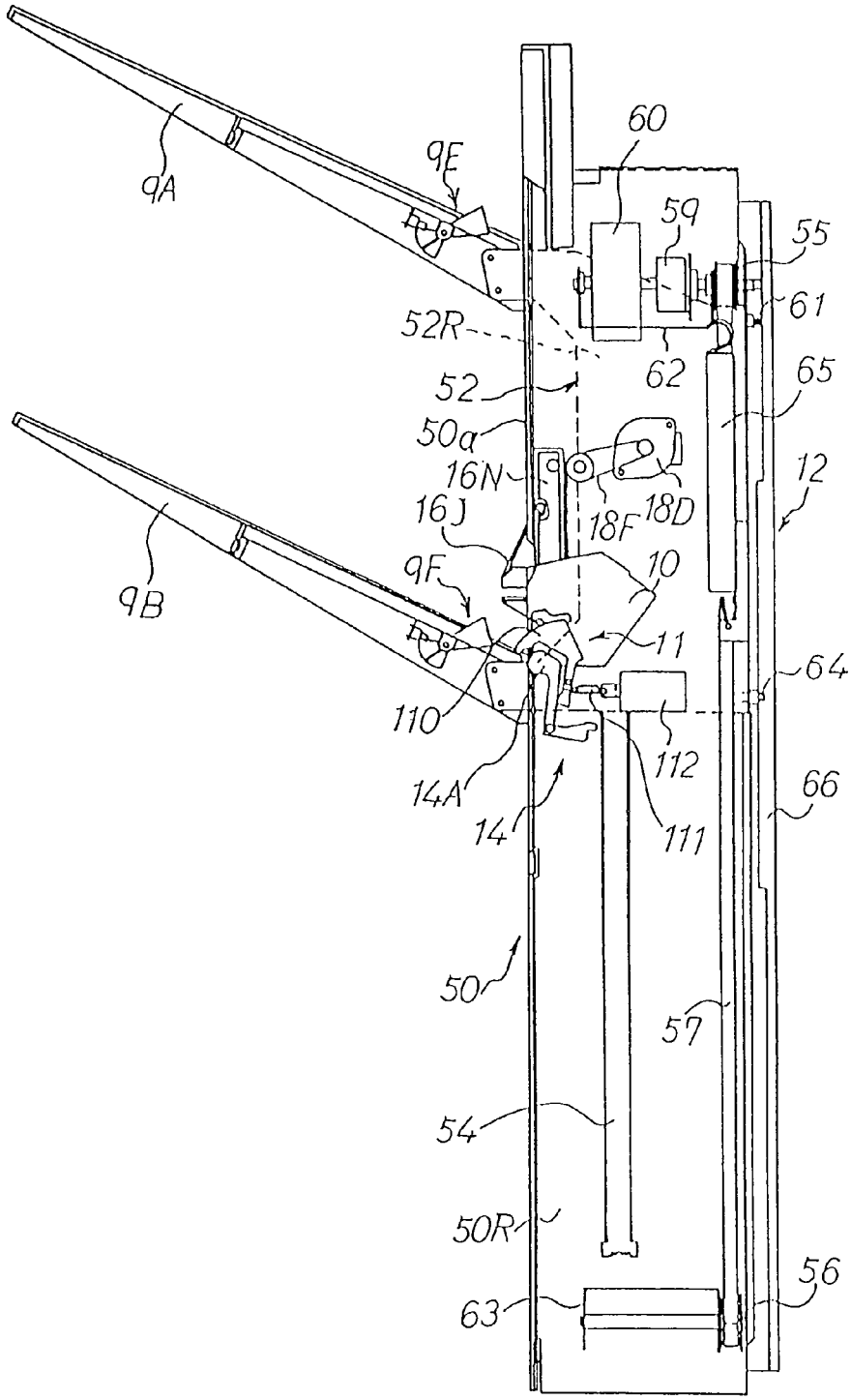
FIG. 5 is a side view showing an inner structure of an accumulation processing device unit.
Figure 6:
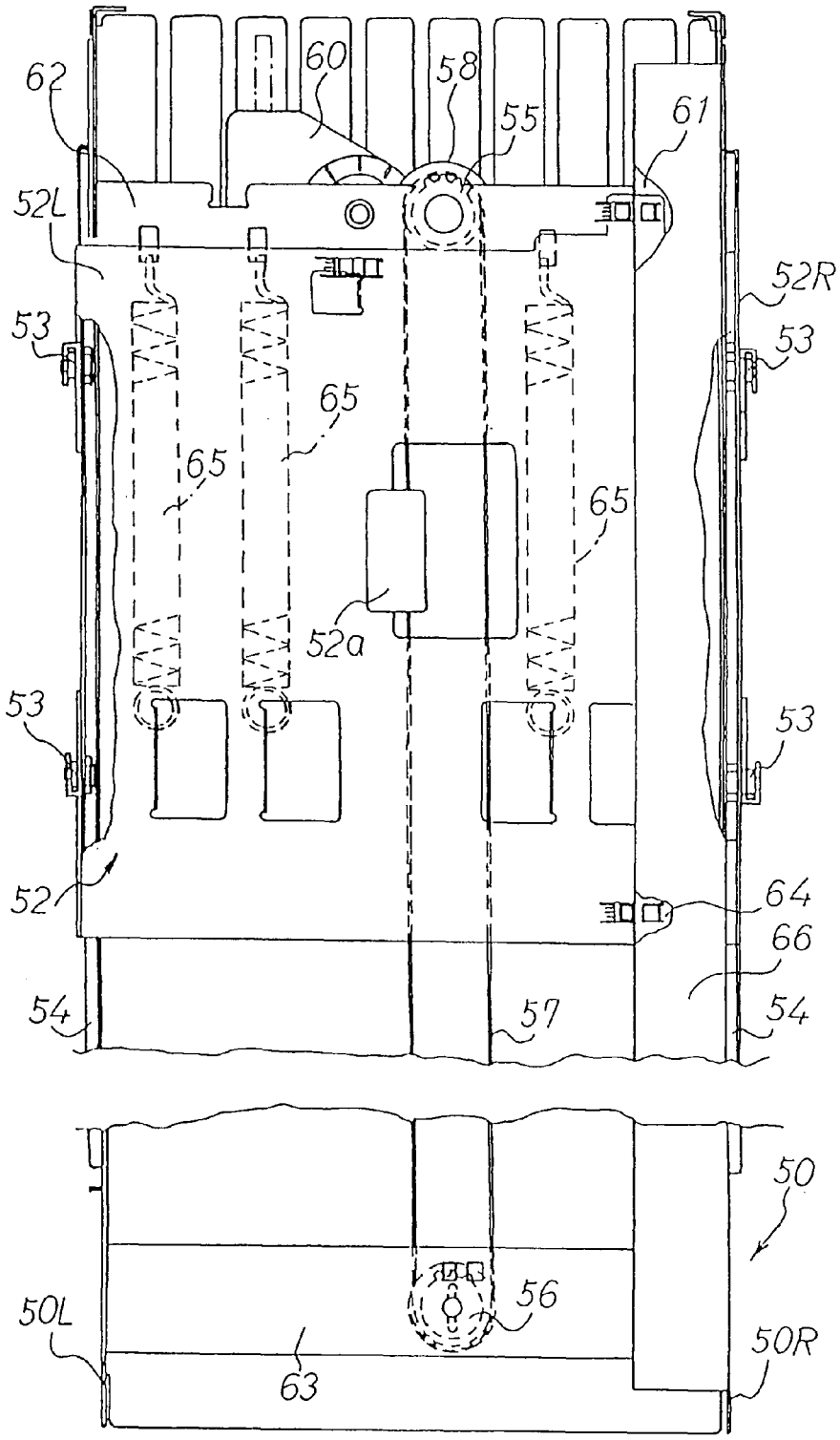
FIG. 6 is a front view showing an inner structure of the accumulation processing device unit.
Figure 7:
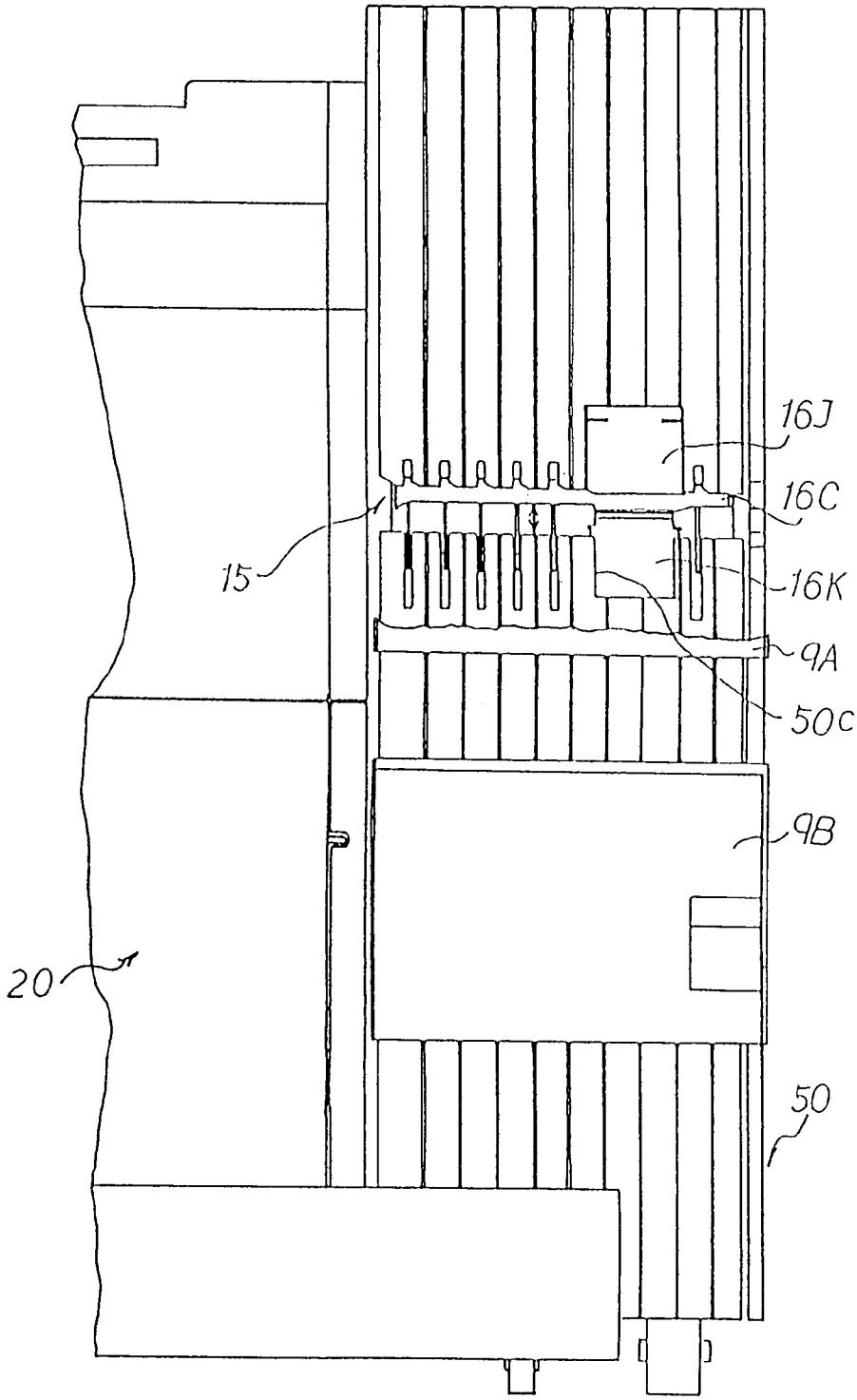
FIG. 7 is a front view showing an appearance of the accumulation processing device.
Figure 8:
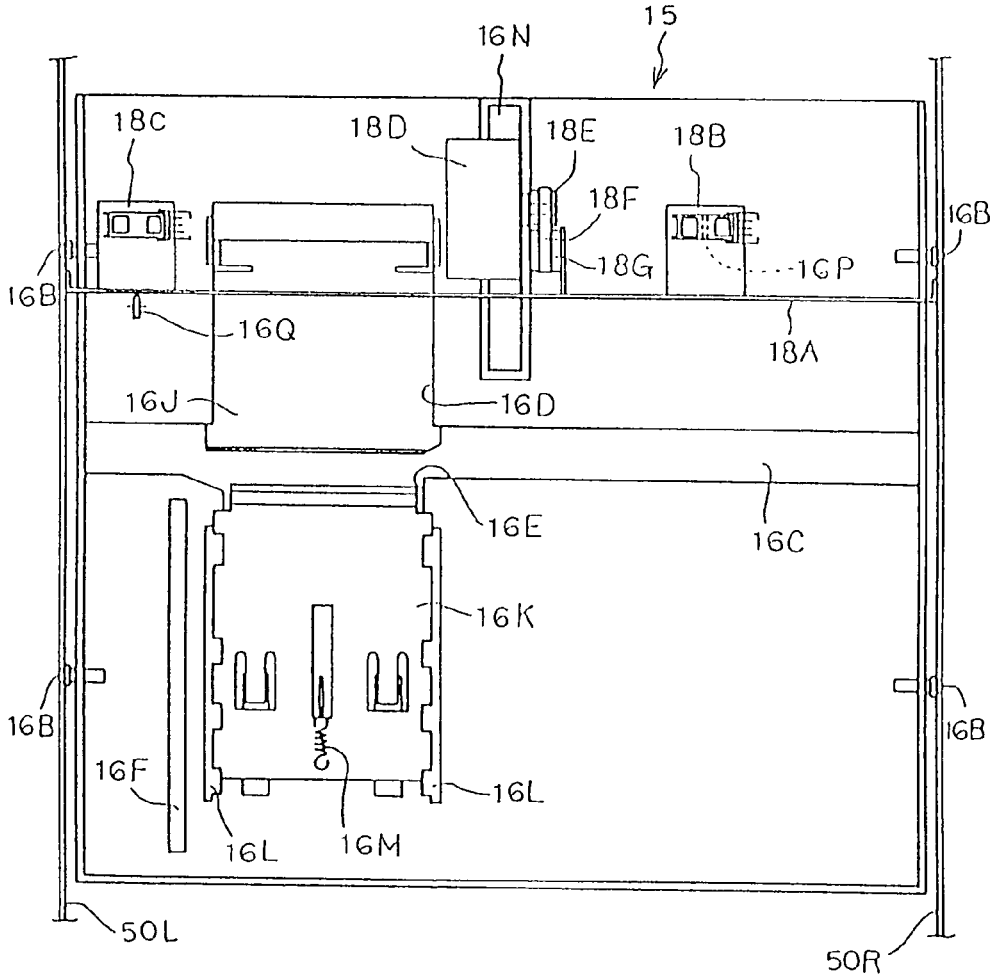
FIG. 8 is a rear view showing a structure of a shutter 15.
Figure 9:
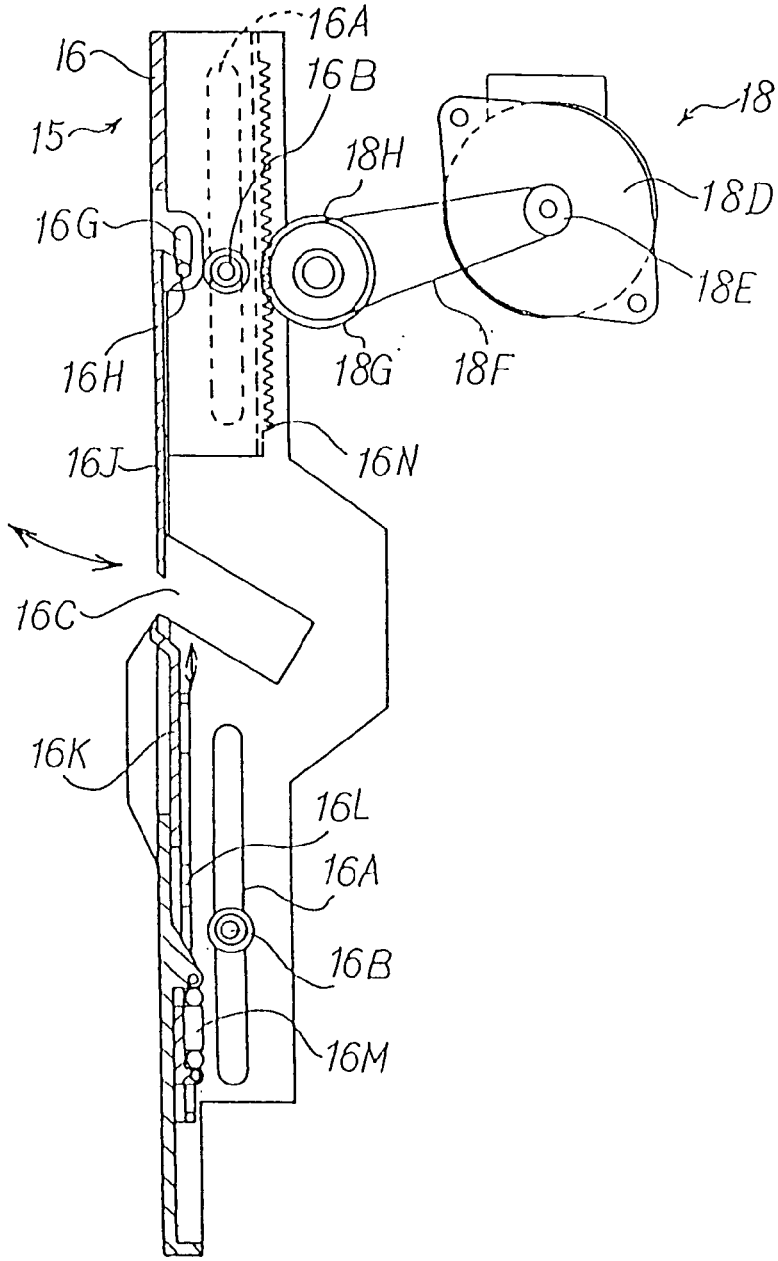
FIG. 9 is a side view showing a mechanism of the shutter 15.

The accumulation processing device unit 50 is provided with, as shown in FIG. 3, the accumulating trays 9A and 9B which can be raised/lowered to accumulate thereon the sheet bunch S' stapled by the stapler 8; a second holding means 10 for receiving and holding the sheet bunch S' held by the first holding means 7 and conveyed to the accumulating tray 9A or 9B and conveying the sheet bunch S' to a predetermined position on the accumulating tray 9A or 9B; as shown in FIGS. 5 and 6, a sheet height detecting means (sheet surface detecting sensor) 11 for detecting the height of the sheet bunch S' accumulated on the accumulating tray 9A or 9B; a halfway taking sensor 14 for detecting that an operator removes the whole or a part of the sheet bunch while the sheet bunch is being accumulated on the accumulating tray 9A or 9B; an elevating means 12 for raising/lowering the accumulating trays 9A and 9B; and, as shown in FIGS. 7 to 9, a shutter 15 for operating when the accumulating trays 9A and 9B are raised/lowered.

The accumulation processing device unit 50 is also, as shown in FIG. 1, provided with a positioning and matching vertical wall 50*a* onto which one side of the sheet bunch S' conveyed to the accumulating tray 9A or 9B abuts; a horizontal opening 50*b* for allowing the second holding means 10 to move in a horizontal direction; and a vertical opening 50*c* interconnected to the horizontal opening 50*b* for allowing the second holding means 10 to rotate in a vertical direction.

The accumulating tray 3 is, as shown in FIG. 3, formed by tilting an outer-frame upper portion of the post-processing device unit 20, and has its upstream side positioned below and its downstream side positioned above. Furthermore, a vertical wall 3*a* is extended from an upstream-side end of the accumulating tray 3, and a releasing opening 3*b* is formed in an upper portion of the vertical wall 3*a*.

As shown in FIG. 4, in the preparatory conveying means 5, a conveying port 21 is formed in one or rear side face of the post-processing device unit 20, and aligned with a discharge port (not shown) of the copying machine 2. On the downstream side of the conveying port 12 a pair of conveying rollers 22 are arranged and a flapper 23A is then provided for switching a conveying path of the sheets S between a path 24A on the side of the upper accumulating tray 3 and a path 24B on the side of the lower processing tray 4. Moreover, the conveying path 24A is provided with pairs of conveying rollers 25A and 25B, while the conveying path 24B is provided with a pair of discharge rollers 26A and 26B and a sensor 17. Additionally, in order to reverse the sheets and discharge the reversed sheets to the processing tray 4, a reversing path 24C is interposed between the conveying paths 24A and 24B. When a rear end of the sheet passes along a reversing flapper 23B disposed in the conveying path 24A, the pairs of conveying rollers 25A and 25B rotate in reverse, a conveying direction of the sheet is reversed, and the sheet is supplied to the reversing path 24C. Additionally, a sensor 23C is attached to the reversing flapper 23B.

The processing tray 4 is positioned below the accumulating tray 3 and tilted in parallel with the accumulating tray 3. A series of sheets S is successively conveyed via the pair of conveying rollers 22 and the pair of discharge rollers 26A and 26B on a terminal end of the path 24B in a discharge direction A toward the processing tray 4, so that the sheets S are stapled by the stapler 8. As shown in FIG. 3, a tilted lower end portion of the processing tray 4 is raised or formed in a direction orthogonal to a tray surface, and an inner face of the raised portion forms the vertical wall 20*a* which abuts on one side of the sheet S extended back and forth in a direction orthogonal to the discharge direction A.

Figure 10:
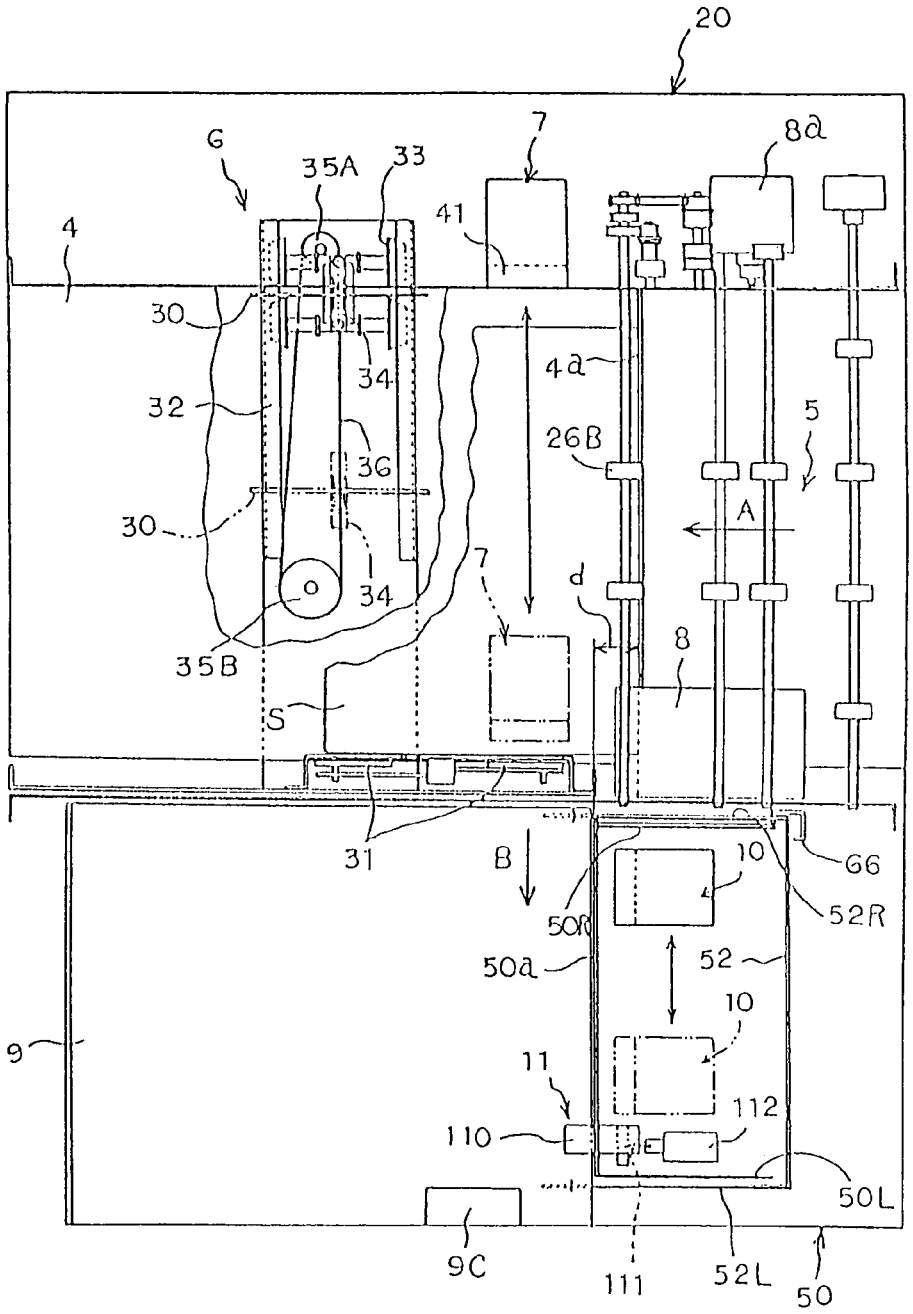
FIG. 10 is a sectional plan view of a sheet processing device.

In the matching means 6, in order to align the bunch S' of plural sheets stored on the processing tray 4, matching is performed before and after the discharge direction by bringing the sheets in contact with the reference surface 4*a* of the processing tray 4 as shown in FIG. 4. As shown in FIG. 10, on right and left sides of the discharge direction matching is performed by the matching members 30 arranged on opposite sides of the processing tray 4 and shutter type reference plates 31 which can be raised/lowered.

In a mechanism for moving the matching members 30, a rail 32 is extended in a transverse direction below the processing tray 4, holding members 34 are disposed for supporting the matching members 30 in such a manner that the matching members 30 can run inside the rail 32 via conical rollers 33, a belt 36 is extended between a pair of pulleys 35A and 35B, and the holding members 34 are partially fixed halfway to the belt 36. Additionally, one pulley 35B is operated by a matching motor 37 (refer to FIG. 17) to move the matching members 30.

While the sheets S are successively conveyed in the discharge direction A in this manner, the matching members 30 are in retreated and opened positions. After receiving the predetermined number of sheets S, the matching members 30 are advanced and pressed onto the reference plates 31 to perform matching.

Figure 16:
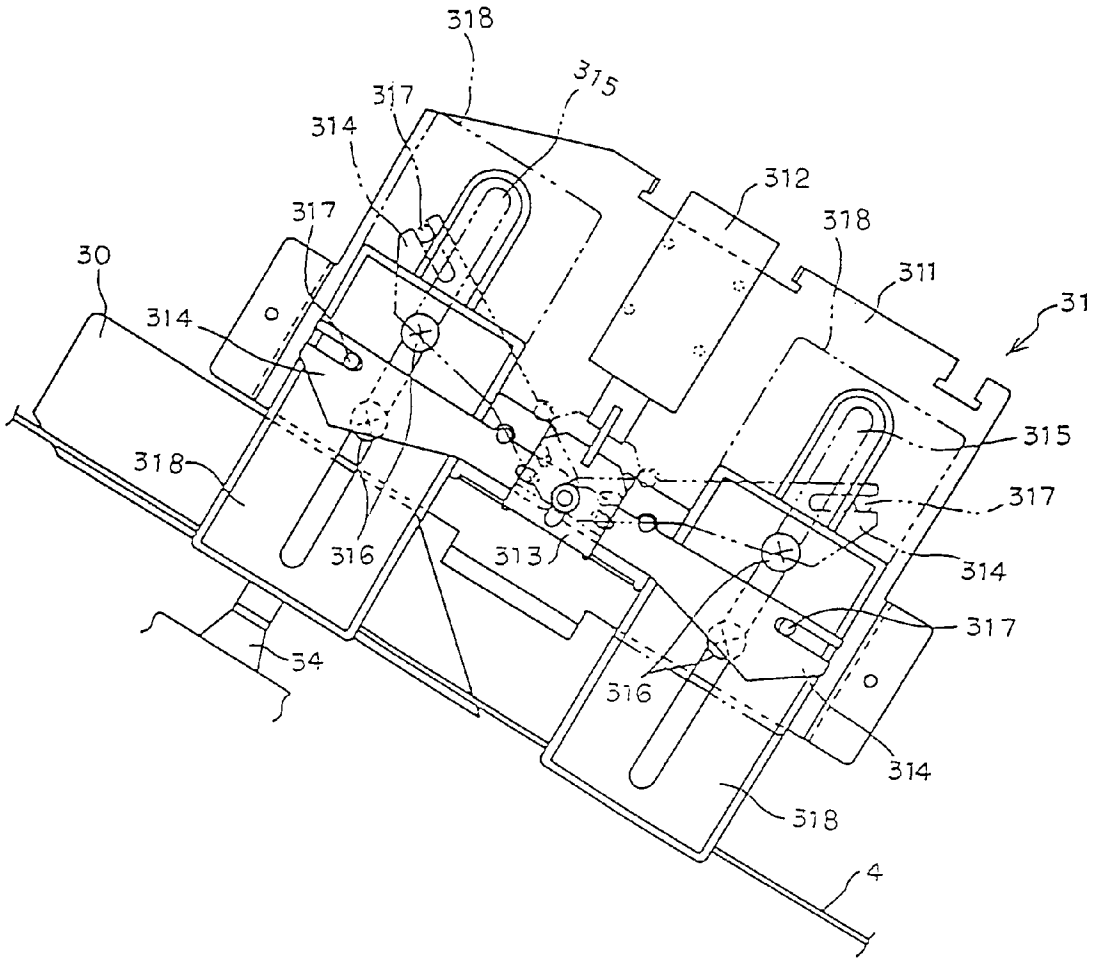
FIG. 16 is an enlarged front view showing a reference plate in the sheet processing device.

As shown in FIG. 16, the reference plate 31 is provided with a fixed plate 311 fixed to an inner wall of the post-processing device unit 20; a shutter solenoid 312 held by the fixed plate 311, an interconnection plate 313 provided on a tip end of the shutter solenoid 312; a pair of arms 314 having one ends interconnected to the interconnection plate 313; and shutter plates 318 interconnected to the other ends of the arms 314 via interconnection pins 316 and 317 for converting rotational movement of the arms 314 to linear movement via guide grooves 315 formed in the fixed plate 311. Additionally, in the process of conveying one sheet bunch S' from the processing tray 4 to the accumulating tray 9A or 9B, when a sheet S forming a base of the next sheet bunch S' is discharged onto the processing tray 4, in order to match the base sheet S, the shutter solenoid 312 rotates the arms 314 in such a manner that the shutter plates 318 abut on a top surface of the sheet bunch S' being conveyed.

Figure 11:
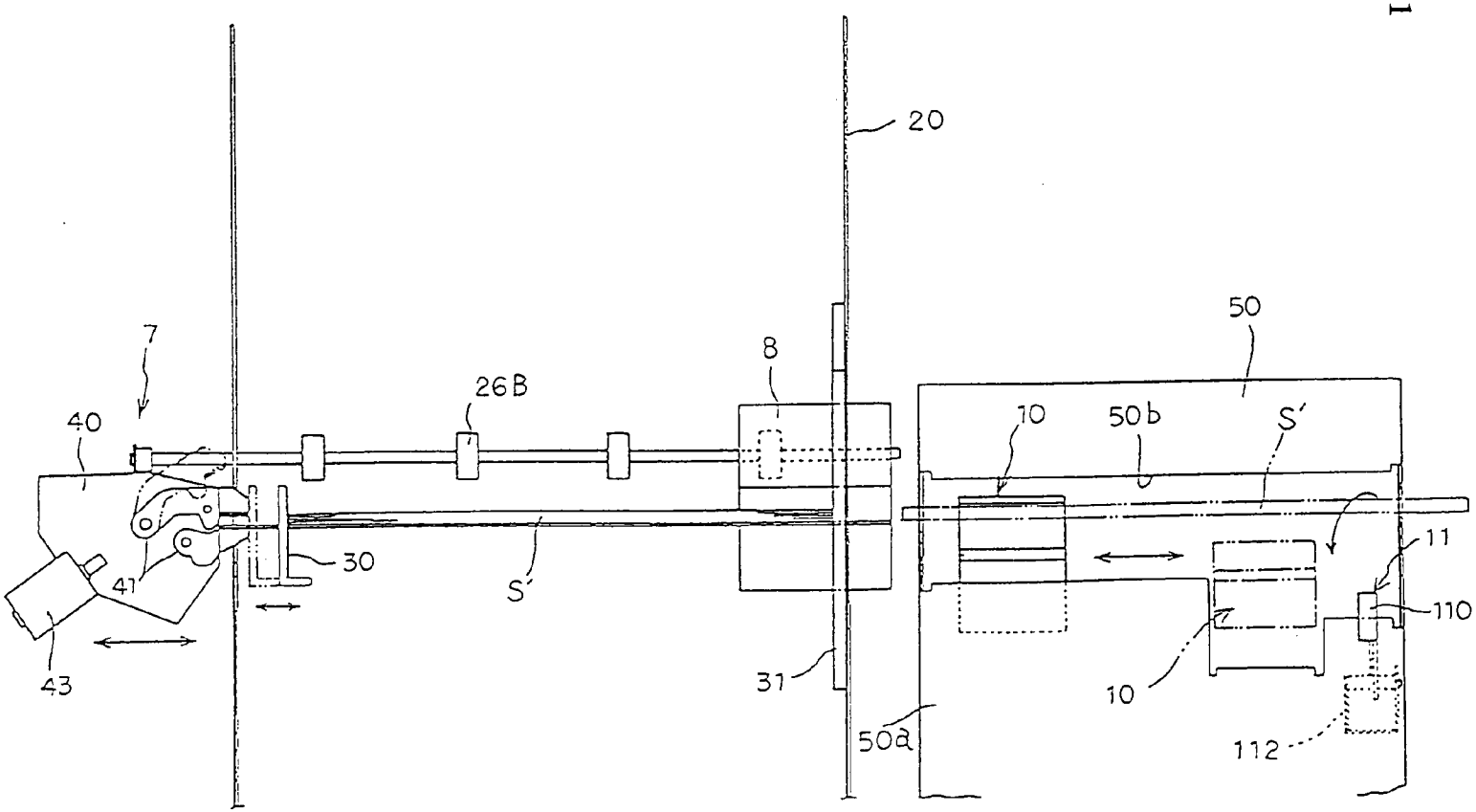
FIG. 11 is a schematic front view of the sheet processing device.

The first holding means 7 holds a rear-end portion of the sheet bunch S' matched on the processing tray 4 from above and below to convey the sheet bunch S' in a conveying direction B orthogonal to the discharge direction A. Furthermore, in the first holding means 7, as shown in FIG. 11, a moving frame 40 is provided with upper and lower holding levers 41 which are opened/closed. A detailed mechanism is not shown, but when a bunch pressing solenoid 43 operates, one side of the sheet bunch S' is held by the holding levers 41. Moreover, the holding levers 41 are advanced/retreated by a holding lever motor 42 of FIG. 17.

Figure 14:
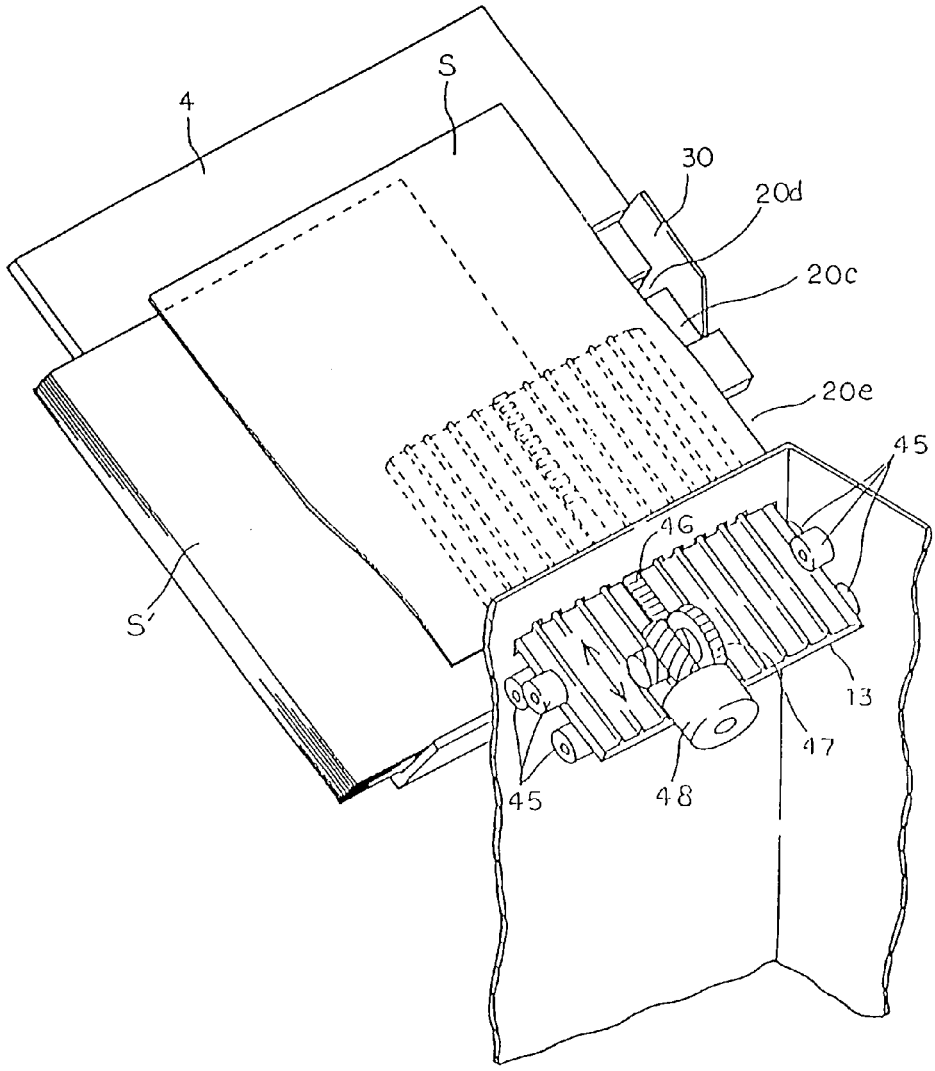
FIG. 14 is a perspective view of an auxiliary tray in the sheet processing device.

Above the processing tray 4 the auxiliary tray 13 formed in a flat plate as shown in FIGS. 4 and 14 is disposed between the processing tray 4 and the pair of discharge rollers 26A and 26B which are rotated by a conveying motor 19. The auxiliary tray 13 is shorter and narrower than the processing tray 4, and disposed in a reference position of the processing tray 4 in such a manner that the auxiliary tray 13 can advance/retreat. Specifically, opposite end portions of the auxiliary tray 13 are slidably supported by upper and lower guide rollers 45, a pinion gear 47 is engaged with a rack 46 in a middle portion, and the auxiliary tray 13 is slid by the pinion gear 47 operatively interconnected to an auxiliary tray motor 48. Additionally, FIGS. 4 and 14 show that the auxiliary tray 13 is moved forward.

When a series of sheet bunches S' is discharged onto the processing tray 4 and the sheet bunch S' is matched, the auxiliary tray 13 is moved forward before the next series of sheets S is conveyed. By receiving the next sheets S, the auxiliary tray 13 separates the sheets S from the sheet bunch S' being conveyed (being stapled).

Figure 15:
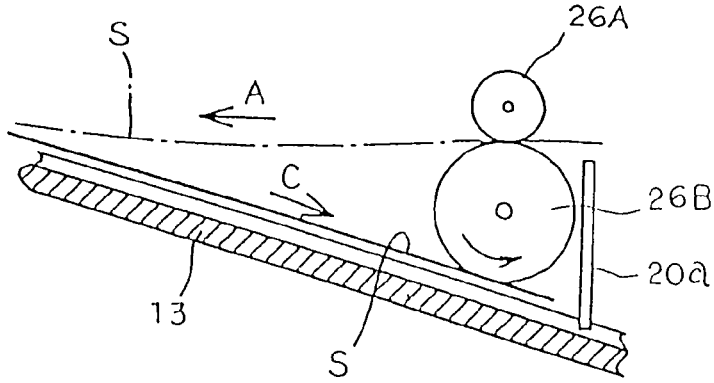
FIG. 15 is an explanatory view showing an operation of the auxiliary tray in the sheet processing device.

As shown in FIG. 15, the auxiliary tray 13 also has a returning function of conveying the sheet S in a returning direction C opposite to the discharge direction A when the sheet S is laid on the auxiliary tray 13. The returning function is performed by the discharge roller 26A and the discharge roller 26B which elastically abuts on the discharge roller 26A. Additionally, the diameter of the discharge roller 26B is larger than that of the discharge roller 26A, and the discharge roller 26B is formed of a soft material. When the outer peripheral face of the discharge roller 26B lightly abuts on the sheet S on the auxiliary tray 13, the tip end of the sheet S is forwarded in the returning direction C to abut on the contact plate 20*a*.

Furthermore, since the auxiliary tray 13 is loaded only with about one or two sheets S, a mechanism which is adapted to changes in thickness of the sheet S is unnecessary. Moreover, a timing of advancing/retreating the auxiliary tray 13 is set based on a detection result of the sensor 17 of FIG. 4 disposed on the upstream side of the discharge direction of the sheet S discharged by the discharge means or rollers 26A and 26B for detecting that the tip end of the sheet discharged by the discharge rollers 26A and 26B reaches the processing tray 4 or a position above the previous sheet S accumulated on the processing tray 4.

Specifically, as shown in FIG. 3, the plural rail grooves 20*c*, 20*d* and 20*e* in the processing tray 4 are extended in a direction orthogonal to the conveying direction of the sheet S. Therefore, in the case where no sheet S is accumulated on the processing tray 4, if the first sheet S is directly discharged on the processing tray 4, the tip end of the sheet S is buckled or caught in the rail groove 20*c*, 20*d* or 20*e* in accordance with the height of the processing tray 4, or another problem occurs. Additionally, even when the sheets S are accumulated on the processing tray 4, the tip end of the next sheet S abuts on the previous sheet S and is buckled. Furthermore, the aforementioned sheet bunch S' needs to be separated from the next sheet S.

To solve the aforementioned problem, by detecting the tip end of the sheet S by the detecting sensor 17, the auxiliary tray 13 is advanced, while by detecting the rear end of the sheet S by the detecting sensor 17, the auxiliary tray 13 is retreated.

In this case, it can be assumed that plural sheet sizes are mixed in one sheet bunch S'. For this, based on the sheet size information transmitted from the copying machine 2 and the sheet detection result of the detecting sensor 17, the retreating timing of the auxiliary tray 13 by means of the auxiliary tray motor 48 is set earlier as the sheet size is larger according to the sheet size information transmitted from the copying machine 2. Thereby, the sheet is prevented from being buckled in accordance with the sheet size. Additionally, even if sheet sizes are not mixed, the retreating timing may be set earlier when the sheet size is larger than an optional sheet size (e.g., A4 sideways) as a reference.

When the sheet bunch S' on the lower processing tray 4 is conveyed to the accumulating tray 9A or 9B, the auxiliary tray 13 is retracted substantially simultaneously with completion of conveyance to the accumulating tray 9A or 9B, thereby dropping the sheet S on the auxiliary tray 13 down to the processing tray 4.

As shown in FIG. 14, when a relatively large-sized sheet S is conveyed to the processing tray 4, the sheet S on the auxiliary tray 13 is supported in such a manner that the sheet S hangs from the auxiliary tray 13 onto the processing tray 4. Additionally, when a small-sized sheet S is conveyed, the sheet S can be received only by the auxiliary tray 13.

The stapler 8 staples the vicinity of edges of the sheet bunch S' with staples (stapling needles), and is disposed in the vicinity of the front end portion of the vertical wall 20*a* of the processing tray 4 on the side of the accumulation processing device unit 50.

Stapling positions and the number of portions of the sheet bunch S' to be stapled by the stapler 8 are reached by conveying the sheet bunch with the first and second holding means 7 and 10. Specifically, when one portion of the sheet bunch is stapled, the sheet bunch is held and conveyed by the first holding means 7, stopped when the portion is aligned with the stapler 8 and stapled. When two portions are stapled, the sheet bunch is held and conveyed by the first holding means 7, and the first portion is aligned with the stapler 8 and stapled. Subsequently, after the second holding means 10 in turn holds the sheet bunch, the second portion is aligned with the stapler 8 and stapled. Additionally, by providing the stapler 8 movably along the discharge direction A, portions to be stapled by the stapler may be variable.

The accumulating trays 9A and 9B are deviated ahead of the processing tray 4 or in a direction orthogonal to the discharge direction A and arranged in parallel with each other, and recesses 9C and 9D for taking the trays are formed in top-surface side edges of the accumulating trays. The accumulating trays 9A and 9B are also provided with sheet presence detecting sensors 9E and 9F.

As shown in FIGS. 5 and 6, the accumulating trays 9A and 9B are arranged in such a manner that the trays are raised/lowered along side walls 50L and 50R of the accumulation processing device unit 50, and the vertical wall 50*a* of the accumulation processing device unit 50 is an accumulation reference plane. The accumulation reference plane is set at a distance d (refer to FIG. 10) in the discharge direction A from the vertical wall 4*a* of the processing tray 4.

Opposite transverse ends of the accumulating tray 9A or 9B are fixedly supported by the side walls 50L and 50R of a U-shaped elevating frame 52, and opposite rollers 53 of the elevating frame 52 are vertically movably guided along vertical grooves 54 formed in the side walls 50L and 50R.

Furthermore, upper and lower frames 62 and 63 on the rear side of the accumulation processing device unit 50 are provided with pulleys 55 and 56, a belt 57 is extended between the upper and lower pulleys 55 and 56, and a follower gear 58 fixed to a rotation shaft of the pulley 55 is engaged with a drive gear 59 of an accumulating tray motor 60 to rotate and operate the upper pulley 55. The elevating frame 52 is fixed halfway to the belt 57 with a fixture 52*a*, and vertically moved as the belt 57 runs.

A spring 65 is also attached between the elevating frame 52 and the upper frame 62, an upward carrying force is obtained from a biasing force of the spring 65, and an alleviating mechanism is constituted in which the weight of the sheet bunch S' on the processing tray 4 is prevented from excessively acting on the accumulating tray motor 60.

The elevating frame 52 is provided with a transmission type upper tray position detecting sensor 61 and a lower tray position detecting sensor 64, so that the positions of the accumulating trays 9A and 9B can be detected dependent on whether or not light is interrupted by a shielding plate 66 attached to the side wall 50R.

Figure 12:
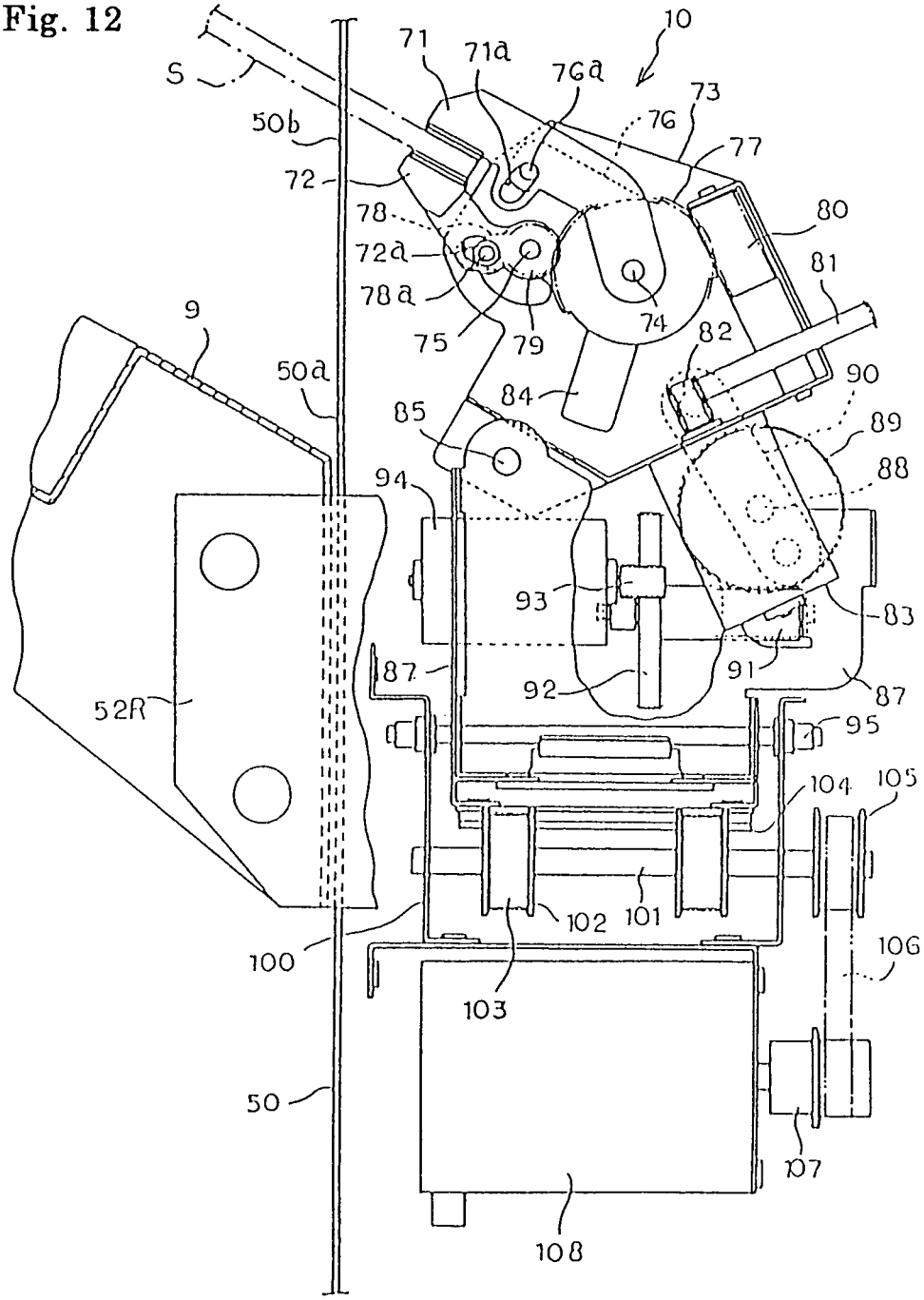
FIG. 12 is an enlarged sectional side view showing a main portion of a second holding means in an initial condition in the sheet processing device.
Figure 13:
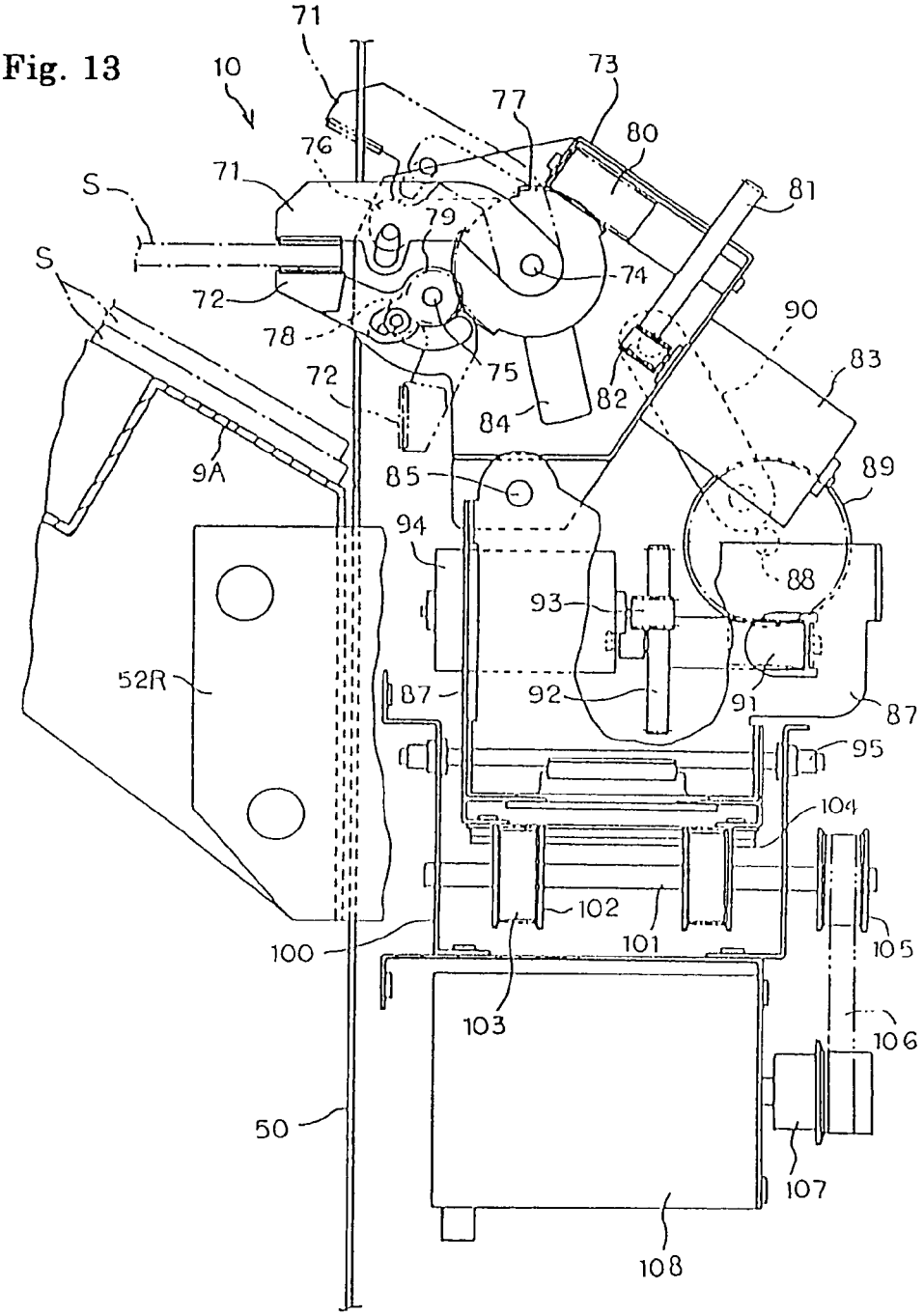
FIG. 13 is an enlarged sectional side view showing a main portion of the second holding means dropping a sheet bunch in the sheet processing device.

As shown in FIGS. 12 and 13, the sheet held by the first holding means 7 is conveyed and pushed from the processing tray 4 onto the accumulating tray 9A or 9B via the second holding means 10. The second holding means 10 also has upper and lower holding levers 71 and 72 for pressing with planes and holding top and under surfaces of the sheet bunch S'. The sheet bunch S' is held/released by an opening/closing mechanism, and the held sheet bunch S' is conveyed by a conveying mechanism in the conveying direction B orthogonal to the discharge direction A. Furthermore, a portion of the sheet bunch S' held in an inclined condition is swung horizontally by a swinging mechanism, and simultaneously moved slightly toward the accumulating tray 9A or 9B.

First, a proximal end of the upper holding lever 71 is rotatably supported by a first shaft 74 relative to a swinging frame 73, and the lower holding lever 72 is rotatably supported via a second shaft 75 by the swinging frame 73. A first arm 76 is supported by the first shaft 74 and rotated integrally with a partial gear 77, and a tip end pin 76*a* of the first arm 76 is engaged in a groove 71*a* in the upper holding lever 71 and operated to open/close. Similarly, a second arm 78 is supported by the second shaft 75, and a tip end pin 78*a* of the second arm 78 is engaged in a groove 72*a* in the lower holding lever 72 and operated to open/close. Additionally, a gear portion 79 is attached to a pivotal portion of the second arm 78, and engaged with the partial gear 77 of the first arm 76 to rotate the upper and lower holding levers 71 and 72 when the arms 76 and 78 are linked and rotated.

A pinion gear 80 supported by the swinging frame 73 is engaged with another portion of the partial gear 77, and a drive gear 82 of an opening/closing motor 83 with the swinging frame 73 attached thereto is engaged with an intermediate gear 81 rotated integrally with the pinion gear 80 to constitute an opening/closing drive mechanism. Additionally, for the opened/closed condition of the upper and lower holding levers 71 and 72, an operation piece 84 rotated integrally with the upper holding lever 71 is detected by a sensor (not shown).

When the second holding means 10 is opened/closed, the upper and lower holding levers 71 and 72 are different from each other in open angle because the diameter of the partial gear 77 of the upper holding lever 71 is large and the diameter of the gear portion 79 of the lower holding lever 72 is small. The upper holding lever 71 is opened by about 30-, while the lower holding lever 72 is opened downward by about 90- (refer to FIG. 13).

A lower end of the swinging frame 73 is swingably supported via a swinging shaft 85 by a moving frame 87. A rotary gear 89 is supported via a shaft 88 parallel with the swinging shaft 85 by the moving frame 87. An eccentric portion of the rotary gear 89 and a rear portion of the swinging frame 73 above the swinging shaft 85 are interconnected by a linkage 90. When the rotary gear 89 is rotated, the swinging frame 73 is swung via the linkage 90 to a retreated position of FIG. 12 or a protruded position of FIG. 13.

An outer peripheral gear portion of the rotary gear 89 is engaged with a pinion gear 91 supported in a direction orthogonal to the swinging shaft 85 by the moving frame 87, and an intermediate gear 92 integral with the pinion gear 91 is engaged with a drive gear 93 of a swinging motor 94 attached to the moving frame 87 to constitute a swinging mechanism.

In a conveying mechanism of the moving frame 87, a running member 95 transversely protruded before and after the moving frame 87 is engaged in a guide groove (not shown) extended back and forth in a guide frame 100 fixed to the device unit 50, and the moving frame 87 is supported in such a manner that the moving frame can move back and forth (in the conveying direction B).

Inside the guide frame 100 front and back pulleys 102 are supported by a pulley shaft 101 (another is not shown) and belts 103 are extended between the opposite pulleys. The moving frame 87 is fixed via a clamp member 104 to portions of the belts 103, a follower pulley 105 is fixed to an end of the pulley shaft 101, and a drive belt 106 is extended between the follower pulley 105 and a drive pulley 107 of a drive shaft of a conveying motor 108 attached to an under portion of the guide frame 100.

By rotating the conveying motor 108 forward or reversely, the moving frame 87 is advanced or retreated in the conveying direction B together with the second holding means 10. An initial position (home position) of the second holding means 10 is a receiving position closer to the processing tray 4, and the second holding means 10 is moved among the receiving position, an intermediate stop position for stapling the sheets with the stapler 8 and a most advanced release position. The second holding means 10 is opened/closed in the initial and release positions, and swung in the release position.

Furthermore, the conveying mechanism and the opening/closing and swinging mechanisms of the second holding means 10 are arranged inside a covering of the accumulation processing device unit 50, so that movement ranges are covered. The slit-like horizontal opening 50*b* is formed in an upper portion of the covering, and the second holding means 10 holding the sheet bunch S' moves along the horizontal opening 50*b*. Additionally, the swung upper and lower holding levers 71 and 72 are protruded from a release end.

As shown in FIG. 5, in the sheet height detecting means 11, a rotating detector 110 having a circular arc-shaped tip end is supported by the fixed frame, and protruded/retracted and rotated via a spring 111 when an actuator 112 is operated. The tip end of the rotating detector 110 can make contact with the top surface of the sheet bunch S' on the accumulating tray 9A or 9B, the top-surface position of the sheet bunch S' on the processing tray 4 is detected with the rotation quantity, and the rising/lowering of the processing tray 4 is controlled.

Operations of the mechanisms are linked and controlled in a control unit. On a control panel the number of sheets, the setting number, the necessity of stapling, the stapling position and the like are set by an operator. Operation of each section is controlled based on the setting.

When the accumulating tray 9A passes the horizontal opening 50*b* and is inclined, the shutter 15 prevents the sheet bunch S' on the accumulating tray 9A from being caught by or going into the horizontal opening 50*b*. The shutter 15 is provided with a shutter plate 16 for opening/closing the horizontal opening 50*b* and a drive section 18 for raising/lowering the shutter plate 16.

As shown in FIG. 9, long holes 16A are formed in upper and lower portions of opposite sides of the shutter plate 16 and, as shown in FIG. 8, the shutter plate 16 is vertically movably supported by pins 16B attached to the side walls 50L and 50R. The shutter plate 16 is also provided with a horizontal opening 16C and openings 16D to 16F.

As shown in FIG. 9, the opening 16D is covered with a movable plate 16J rotatably supported via a shaft 16H in a long hole 16G and, as shown in FIG. 5, the plate 16J is pushed out by rotation/operation of the second holding means 10.

Opposite sides of an elevating plate 16K are liftably supported by guides 16L in the opening 16E and, as shown in FIG. 5, the elevating plate 16K is pushed down by the rotation/operation of the second holding means 10. The elevating plate 16K is reset by a spring 16M. Therefore, when the second holding means 10 is not rotated, the movable plate 16J and the elevating plate 16K are closed safely.

The opening 16F is a hole via which the rotating detectors 110 and 14A of the sensors 11 and 14 go in/out.

The shutter plate 16 is also provided with a rack 16N, an opened position detecting lever 16P and a closed position detecting lever 16Q.

On the other hand, a support frame 18A is horizontally attached between the side walls 50L and 50R, and there are the drive section 18, a sensor 18B for detecting the opened position detecting lever 16P and a sensor 18C for detecting the closed position detecting lever 16Q.

The drive section 18 is provided with a pulse motor 18D, a timing pulley 18E, a timing belt 18F, a timing pulley 18G and a pinion 18H engaged with the rack 16N.

When a copying operation is started, the shutter plate 16 is lowered, and the horizontal opening 16C is aligned with the horizontal opening 50*b* and opened. When the copying of the set number of sheets is completed, the shutter plate 16 is raised to close the horizontal opening 16C.

Figure 17:
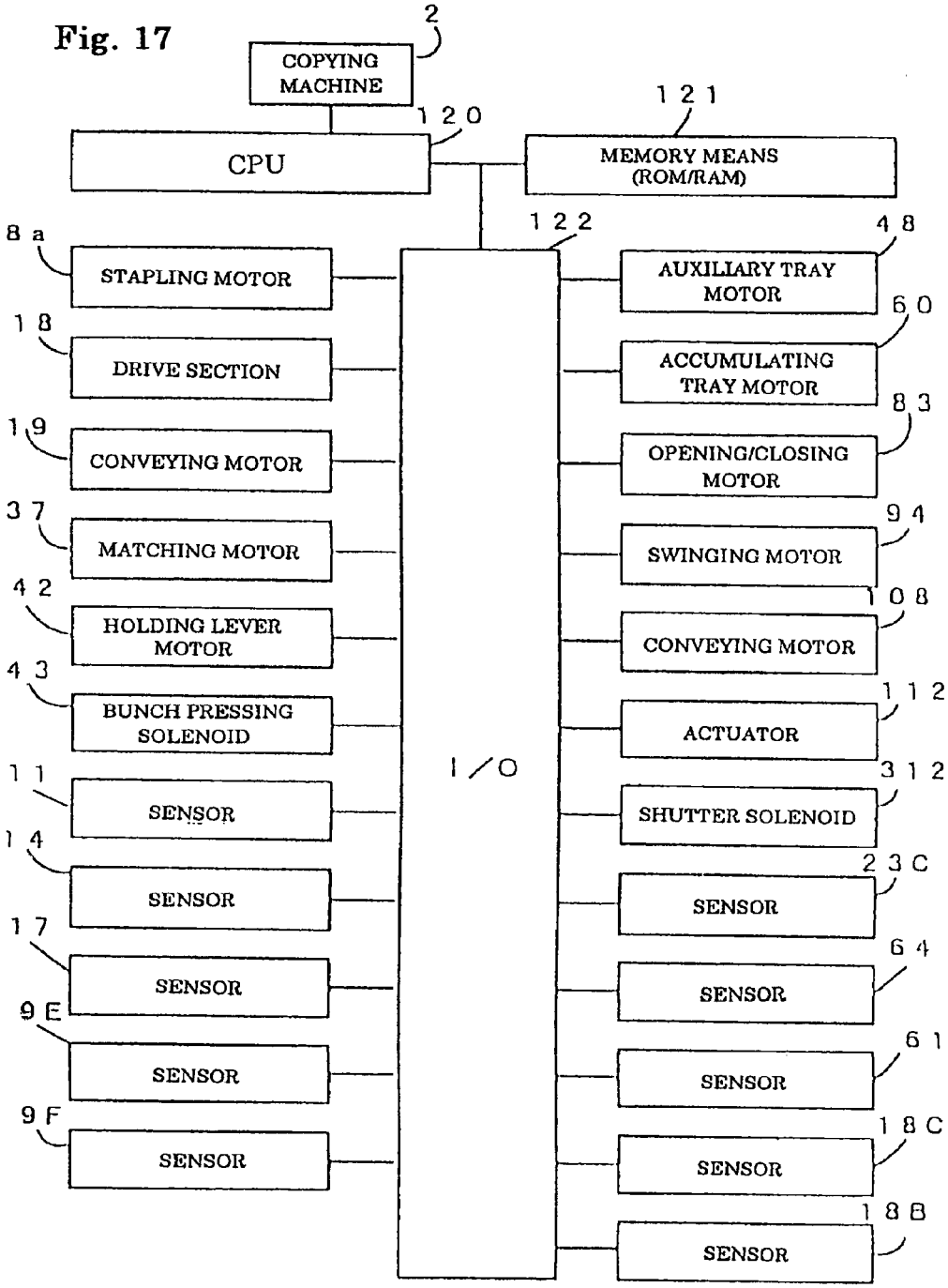
FIG. 17 is a block diagram of a control system in the sheet processing device.

In the aforementioned drive system, as shown in FIG. 17, in response to input/output signals from a CPU 120 and a memory means 121 such as a ROM, a RAM and the like, a parallel I/O 122 is operated and controlled.

Figure 18:
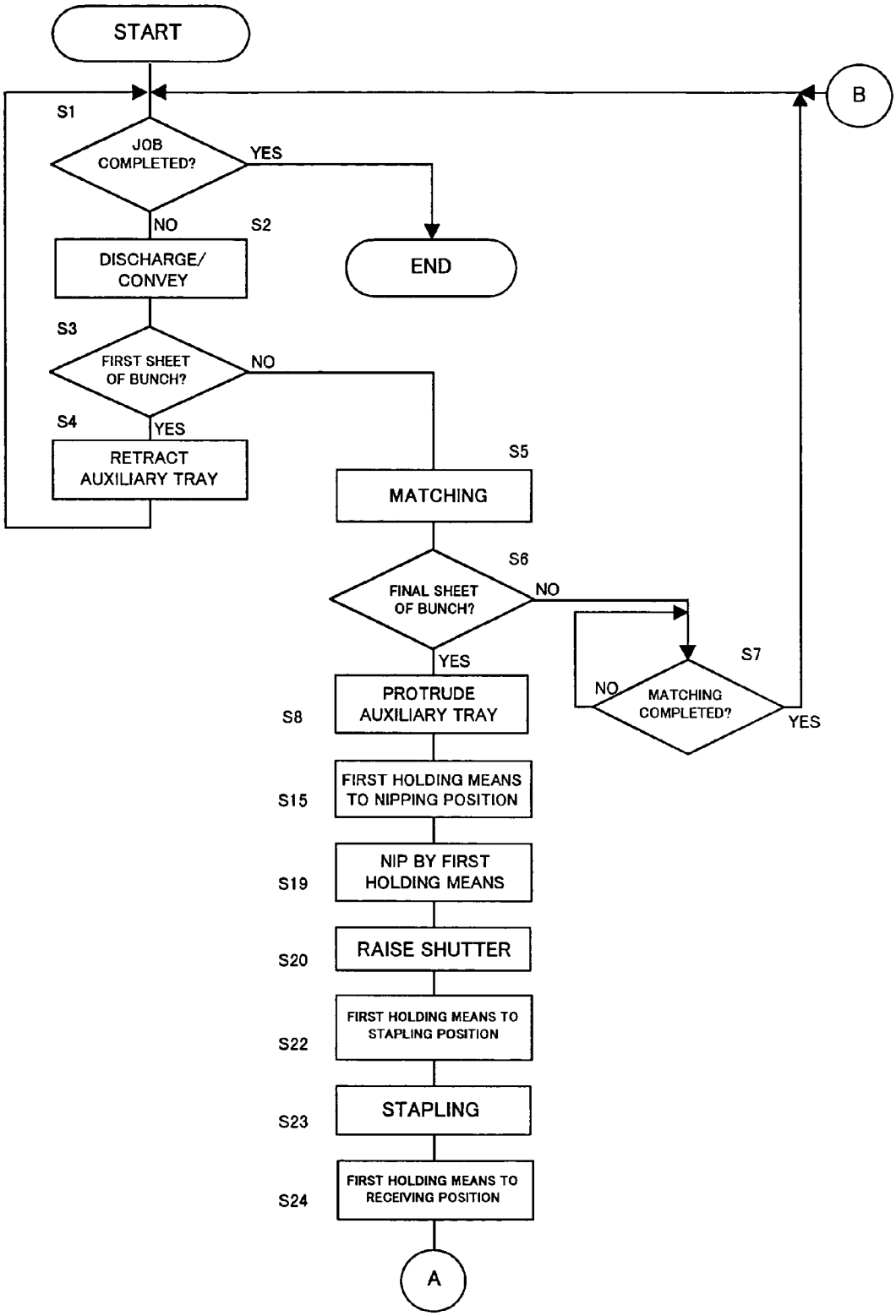
FIG. 18 is a first-half flowchart showing post-processing processes of the sheet processing device.
Figure 19:
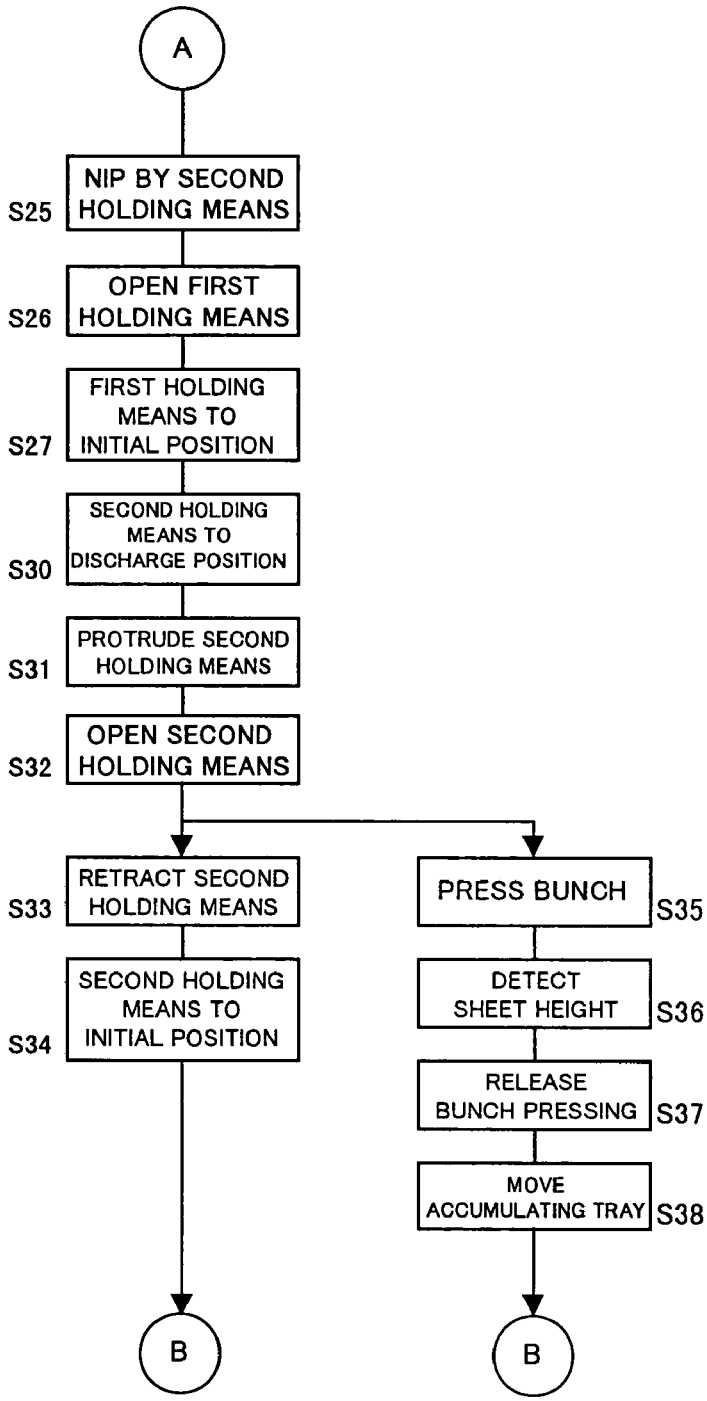
FIG. 19 is a latter-half flowchart showing the post-processing processes of the sheet processing device.
Figure 20:
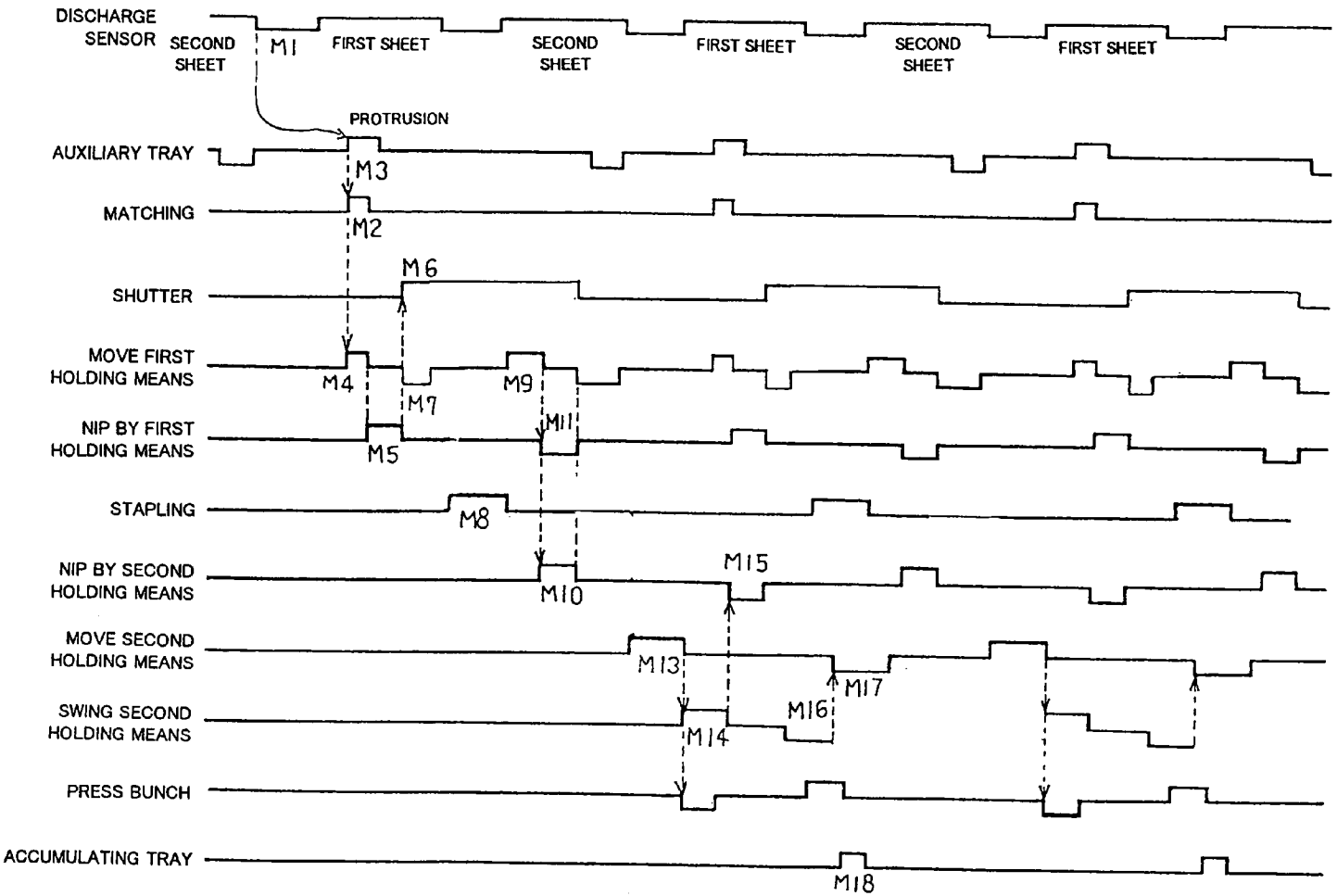
FIG. 20 is a timing chart showing the post-processing processes of the sheet processing device.

Post-processing processes of the sheets S will be described with reference to FIGS. 18 to 21. Additionally, in flowcharts of FIGS. 18 and 19 showing a series of post-processing processes and a timing chart of FIG. 20, two sheets S of the same size form a sheet bunch S'. After corners of the sheets are bound with a stapler, the sheet bunch is accumulated. Additionally, in FIG. 20 numerals affixed to code M represent operation division or operation time.

One of the two trays 9A and 9B is moved in accordance with conditions of the sheet presence detecting sensors 9E and 9F of the accumulating trays 9A and 9B and the tray position detecting sensors 61 and 64. When the image forming device 2 starts its image forming operation, the motor 18D is driven, and the shutter plate 16 is lowered. When the sensor 18B detects the opened position detecting lever 16P, the motor 18D is stopped. In the condition, the horizontal opening 50*b* is aligned with the horizontal opening 16C of the shutter plate 16 and, as shown in FIG. 1, the opening 50*b* is opened.

In the flowchart of FIG. 18, when a job is started, it is first judged whether or not the job is completed (S1). Since the job has just started, the sheet discharged from the image forming device 2 (S3) is a first sheet of a bunch (S3), the auxiliary tray 13 is retracted (S4) and the sheet is stored on the processing tray 4. Since the processing tray 4 is inclined with the reference face 4*a* positioned below, the rear end of the discharged sheet in the discharge direction abuts on the reference face 4*a*, so that its side edge is aligned. When the second sheet is discharged (S3) (M1: operation of a discharged sheet sensor (not shown) and a conveying motor), the matching member 30 is moved to push the rear side of the sheet S and push its front side against the reference plate 31, thereby matching the back and forth direction of the sheet bunch S' (S5, M2: matching). Additionally, if the sheet S is not the final sheet of the bunch (S6), it is checked whether matching is completed (S7). In this case, since the second sheet is the final sheet, the auxiliary tray 13 is protruded after the second sheet is discharged (S8, M3). The next first sheet is held above the second sheet which is being matched on the processing tray 4.

Figure 21:
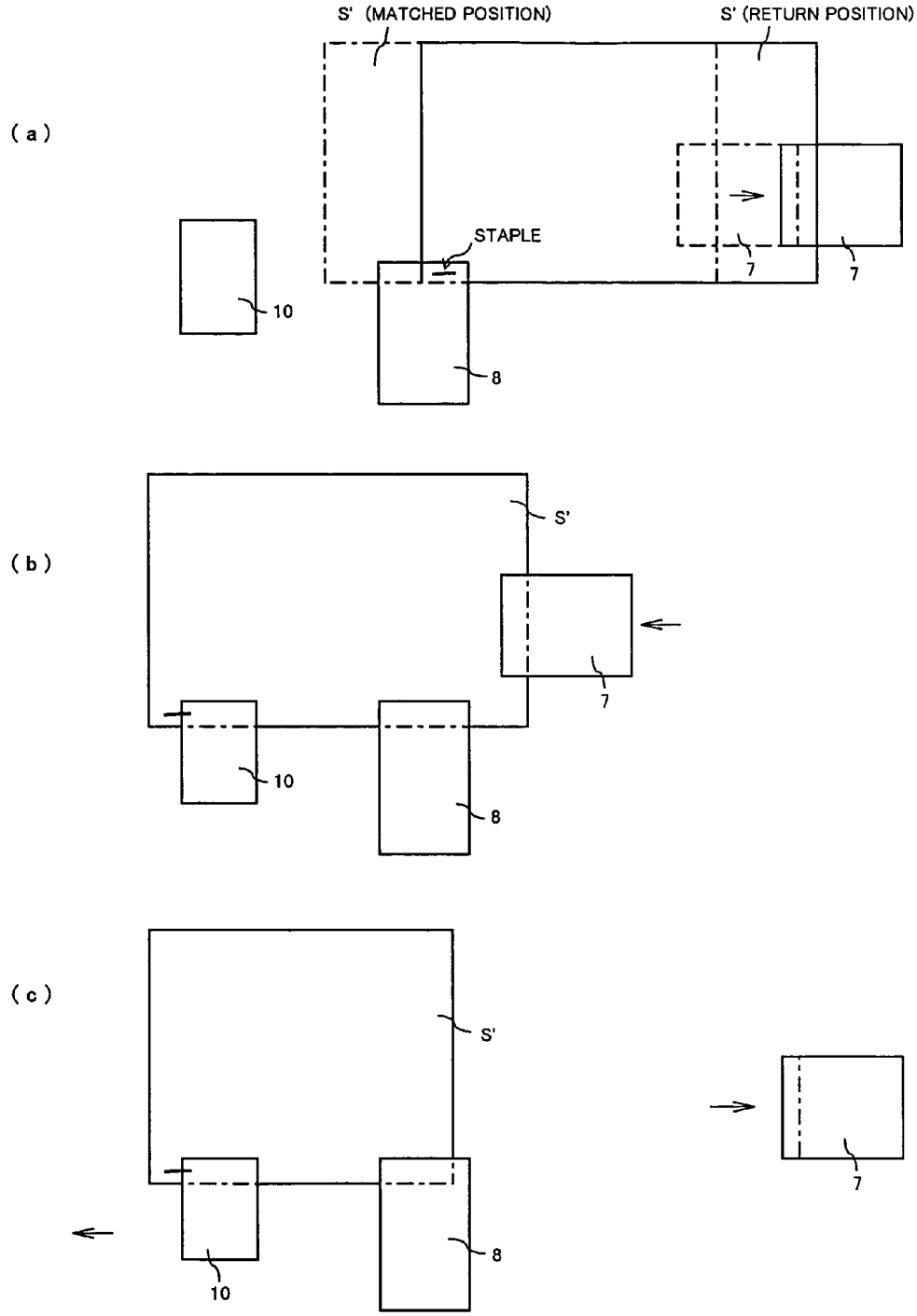
FIGS. 21A to 21C are explanatory views showing post-processing processes for stapling and transferring a sheet bunch from a processing tray to an accumulating tray in the sheet processing device in time series.

FIG. 21 shows strokes in which the sheet bunch S' is transferred from the first holding means 7 to the second holding means 10 when the sheet bunch S' is transferred from the processing tray 4 to, for example, the accumulating tray 9A (to the left in FIG. 21). FIGS. 21A to 21C show conditions in which the conveying of the sheet bunch S' successively proceeds.

When matching is performed, the first holding means 7 moves to a nipping position (shown by a chain line in FIG. 21) (S15, M4). Subsequently, the rear side of the matched sheet bunch S' in the discharge direction toward the accumulating tray is nipped by the first holding means 7 (S19, M5, shown by a chain line in FIG. 21A).

Here, in the post-processing device of the invention, as shown in FIG. 21A, the stapler 8 is disposed inside the matched end of the sheet bunch S' in the matched position on the side of the transfer direction B. Therefore, when the corner of the sheet bunch S' is stapled, the sheet bunch S' needs to be once pulled back only by a predetermined distance in a direction opposite to the conveying direction B. The reference plate 31 is raised (S20, M6). Additionally, the sheet bunch S' is pulled back, a binding position on the corner of the sheet bunch S' is aligned with the stapling position of the stapler 8 (S22, M7, FIG. 21A), and the sheet bunch S' is bound by the stapler 8 (S23, M8). Subsequently, the first holding means 7 moves the sheet bunch S' in the conveying direction B and stops in a receiving position of the second holding means (S24, M9, FIG. 21B). At this time, the second holding means 10 is stopped in an initial position on the side of the processing tray 4 (shown by solid lines in FIGS. 10 and 11), positioned in a retracted position of FIG. 12 and waits for the stopping of the first holding means 7. The second holding means 10 receives and holds one side of the tilted sheet bunch S' on the side of the reference position in its stopped attitude (S25, M10).

When the second holding means 10 nips the sheet bunch S', the reference plate 31 in its raised position is lowered. In the lowered condition, the reference plate 31 lightly presses the sheet bunch S' to allow the sheet bunch S' to pass.

After nipping is performed by the second holding means 10 as aforementioned, the first holding means 7 is opened (S26, M11, FIG. 21C) and moves to the initial position (shown by a solid line of FIG. 10) to hold the next sheet bunch S' (S27), so that the next sheet bunch S' can be transferred.

Subsequently, the second holding means 10 moves to a forward discharge position (shown by chain lines in FIGS. 10 and 11), finishes conveying in the conveying direction B and stops (S30, M13). In the discharge position, the second holding means 10 is swung from the retracted or swung position shown in FIG. 12 to a protruded position shown in FIG. 13. The second holding means 10 is placed in its horizontal nipping condition and moved in a direction orthogonal to the conveying direction B (S31, M14). Additionally, when the second holding means 10 is swung from the retracted or swung position of FIG. 12 to the protruded position of FIG. 13, the movable plate 16J is rotated and the elevating plate 16K is lowered by the second holding means 10.

The end position aligned with the reference position on the processing tray 4 is nipped and conveyed by the second holding means 10 as shown in FIG. 12. When the second holding means 10 is swung to the condition shown in FIG. 13, the nipped end of the sheet bunch S' is moved toward the accumulating tray 9A. The moved position substantially coincides with the reference face 50*a* in the accumulating tray 9A. The nipped sheet end becomes horizontal while being moved (M14), and the upper and lower holding levers 71 and 72 are operated to open as shown by chain lines (S32, M15). Then, the nipped sheet bunch S' is dropped and discharged downward as it is, and accumulated onto the accumulating tray 9A.

When the second holding means 10 is operated to open, the swinging frame 73 is retracted (S33, M16) and the second holding means 10 is moved rearward along the conveying direction B to return to the initial condition (S34, M17). At this time, even if the next sheet bunch S' is conveyed, the upper and lower holding levers 71 and 72 are sufficiently opened. Therefore, the sheet bunch S' fails to interfere with the upper and lower holding levers 71 and 72. Subsequently, the levers can be operated to close and nip the next sheet bunch S' in the initial position.

As aforementioned, when the second holding means 10 is swung to the horizontal condition (M14), the actuator (bunch pressing solenoid) 112 is operated, the rotating detector 110 is placed in a sheet-bunch pressing condition (S35), and a sheet height is detected (S36). Subsequently, the operation of the actuator 112 is canceled, and the pressed condition is released (S37, M18). When the sheet is higher than the predetermined position, the accumulating tray 9A is operated by the elevating means 12 to go down to a predetermined level (S38, M19). Additionally, when the accumulated sheet bunch S' is taken out by an operator halfway, the accumulating tray 9A is raised following the detection of the halfway taking sensor 14.

Since the second holding means 10 is operated to move inside a cover at the time of conveying in the back and forth direction, the second holding means 10 and its conveying mechanism fail to interfere with the operator who is taking the sheet bunch S' on the accumulating tray 9A. Additionally, since the nipped sheet bunch S' is conveyed, the matched condition of the sheet bunch S' is prevented from being disturbed during the conveying. Here, when the sensor 11 detects that, for example, a predetermined number of or more sheets are stored in the accumulating tray 9A, the motor 60 shown in FIG. 5 is operated, the elevating frame 52 is raised, and the lower tray 9B is moved to stop in a storage position. At this time, since the shutter 15 is closed, the sheet on the accumulating tray 9A is inhibited from entering the horizontal opening 50*b*. Thereafter, the sheet bunch is accumulated onto the accumulating tray 9B in the same manner.

In the embodiment described above, the first and second holding means 7 and 10 are constituted of the holding levers for pressing and holding the sheet bunch in plane configurations, but the sheet bunch may be pressed and held by rollers or the like from above and below. Each conveying mechanism can be varied, and the actuator can be changed into a known mechanism.

Furthermore, in the embodiment, the invention is applied to the copying machine 2 as the image forming device, but the invention may be applied to the copying machine 2 in both digital and analog systems. Additionally, it is natural to apply the invention to a printer (including a laser printer), a facsimile machine or other various image forming means (image record devices).

Figure 22:
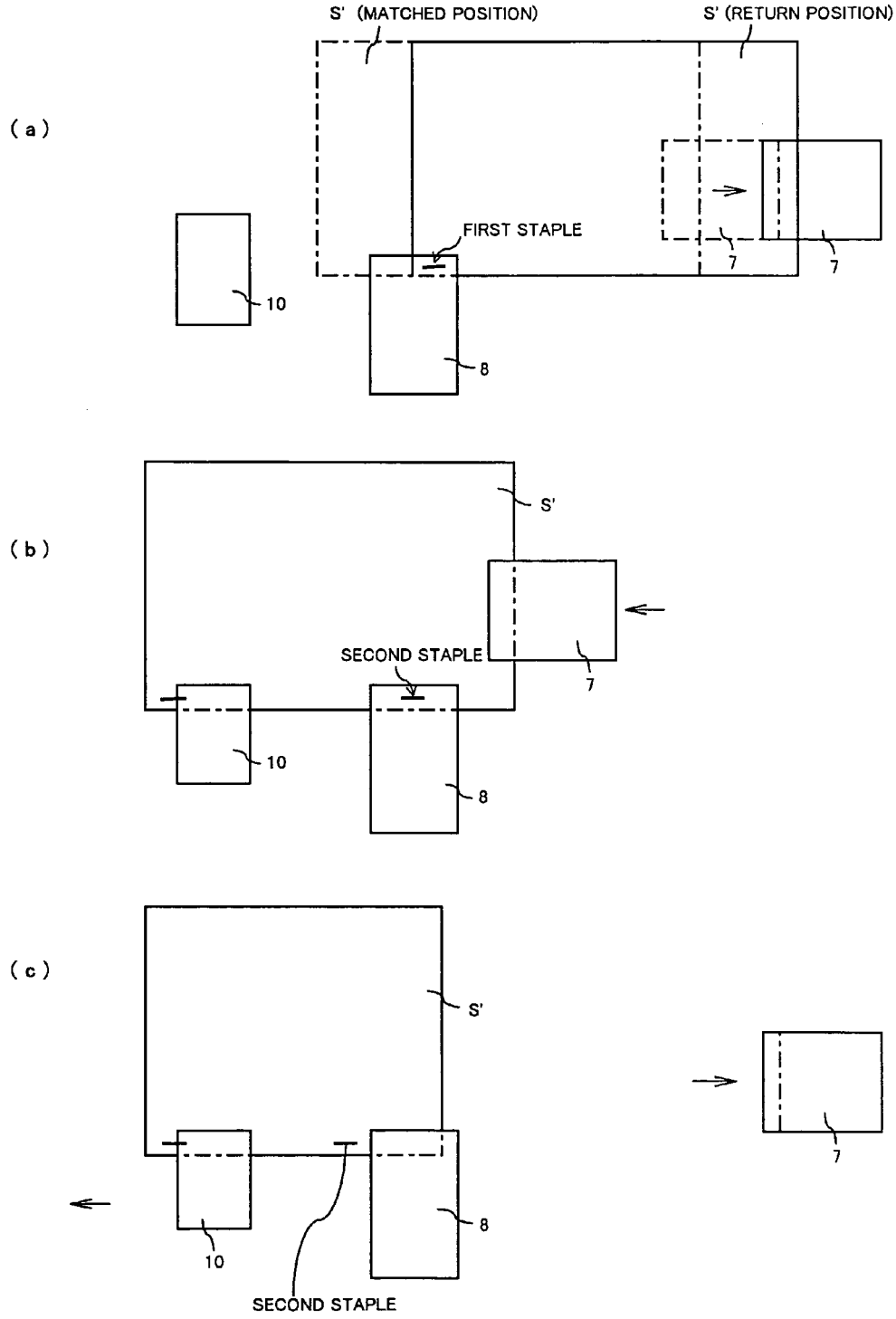
FIGS. 22A to 22C are explanatory views showing a modification of FIG. 21 in which plural portions can be stapled.

Moreover, in the embodiment, the case where one corner is bound has been described. Alternatively, as shown in FIG. 22, after the corner is bound (FIG. 22A), one portion or plural portions of the sheet bunch S' may be stapled by operating the stapler 8 while the sheet bunch is moved (FIG. 22B).

As aforementioned, in the conventional art, the transverse width of the processing-device housing is determined in consideration of at least the width (determined by the maximum width of the sheet to be processed) of the sheet discharge port disposed on the processing tray, the size of the stapler disposed in one end on the processing tray and the size of the holding means disposed in the other end on the processing tray. As a result, the transverse width of the processing device should be large-sized.

In the post-processing device of the invention, the conveying means (first holding means) is constituted to be movable in the direction opposite to the conveying direction of the sheet bunch, and the stapler 8 is disposed inside the matched end of the conveying direction in the matched position of the sheet bunch S'. Therefore, the corner of the sheet bunch can be stapled, while the transverse width of the sheet post-processing device housing can be made small-sized.

What is claimed is:

1. A sheet post-processing device which comprises:

storage means for storing sheets conveyed from an image forming device;

matching means for regulating at least one end of a sheet bunch stored by said storage means to match said end of sheet bunch at a predefined matching position;

staple means for stapling said sheet bunch stored by said storage means;

first holding means for gripping and conveying said sheet bunch matched at the matching position back in a first direction opposite to said one end of said sheet bunch matched at the matching means, and subsequently conveying said sheet bunch forward in a second direction, second holding means to subsequently gripping and conveying said sheet bunch forward further in the second direction toward said one end of said sheet bunch; and a controlling means for controlling said stapling means so as to perform a first stapling after once the first holding means gripping and conveying the sheet bunch back in the first direction from said matching position and subsequently perform a second stapling or multiple staplings while the second holding means grips the sheet bunch after the first holding means conveying said sheet bunch forward in the second direction and prior to the second holding means conveys the sheet bunch further in the second direction.

2. The sheet post-processing device according to claim 1 wherein, when said first holding means once transfers the sheet bunch matched by said matching means toward the other end of said sheet bunch, a binding position of the sheet bunch, which is positioned between said matching means and a stapling position of said stapling means, in a position where the sheet bunch is matched by said matching means is moved toward said stapling position.

3. The sheet post-processing device according to claim 2 wherein after said first holding means transfers said sheet bunch toward said other end and said stapling means staples the binding position of the sheet bunch positioned between said matching means and the stapling position of said stabling means, said stapling means staples one portion or plural portions of the sheet bunch while the sheet bunch is transferred toward said one end.

4. The sheet post-processing device according to claim 1 wherein when said first holding means transfers the stapled sheet bunch toward said one end, said matching means is retracted from a matching position.

5. The sheet post-processing device according to claim 1 wherein stapling means is disposed on a side edge in a direction orthogonal to a conveying direction of the sheet bunch.

6. The sheet post-processing device according to claim 1 which further comprises an accumulating section for accumulating the sheet bunch which is transferred to said one end by said transfer means after stapled by said stapling means.

7. The sheet post-processing device according to claim 1 wherein said matching means are disposed on front and rear rend of the conveying direction of the sheet bunch, and the stapling means is disposed between the front-end and rear-end matching means.

8. The sheet post-processing device according to claim 7 wherein when said first holding means once transfers the matched sheet bunch toward said other end, said rear-end matching means is retracted from a matching position.

9. The sheet post-processing device according to claim 1, wherein said matching means comprises a first matching member fixed in the conveying direction and a second movable matching member for pushing the sheet bunch onto the said first matching member fixed in the conveying direction.

10. The sheet post-processing device according to claim 1, wherein said first holding means holds the sheet bunch at an edge of the sheet bunch other than where stapling occur.

* * * * *